US008897691B2

(12) United States Patent
Imazu et al.

(10) Patent No.: US 8,897,691 B2
(45) Date of Patent: Nov. 25, 2014

(54) SHEET FOLDING APPARATUS AND IMAGE FORMATION SYSTEM PROVIDED WITH THE APPARATUS

(75) Inventors: Hiroki Imazu, Kofu (JP); Shinichi Ito, Kofu (JP); Toshiaki Kagami, Yamanashi-ken (JP); Mizuho Shirakura, Fuefuki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 13/456,887

(22) Filed: Apr. 26, 2012

(65) Prior Publication Data

US 2012/0275838 A1 Nov. 1, 2012

(30) Foreign Application Priority Data

Apr. 27, 2011 (JP) ..... 2011-099384
Apr. 27, 2011 (JP) ..... 2011-099385

(51) Int. Cl.

| | |
|---|---|
| ***G03G 15/00*** | (2006.01) |
| ***B42C 1/00*** | (2006.01) |
| ***B65H 45/12*** | (2006.01) |
| ***B65H 45/14*** | (2006.01) |

(52) U.S. Cl.

CPC ..... *G03G 15/6582* (2013.01); *B65H 45/12* (2013.01); *B65H 45/144* (2013.01); *B65H 2801/27* (2013.01); *G03G 2215/00877* (2013.01)

USPC ..... 399/407; 399/397; 270/46

(58) Field of Classification Search

CPC .... B65H 45/04; B65H 45/105; B65H 45/107; B65H 45/12; B65H 45/20; B65H 45/18

USPC ..... 270/32, 45, 46, 51; 399/397, 407

See application file for complete search history.

(56) References Cited

U.S. PATENT DOCUMENTS

| | | | | |
|---|---|---|---|---|
| 3,984,659 | A * | 10/1976 | Bilbrey | 235/475 |
| 7,111,837 | B2 * | 9/2006 | Itou et al. | 270/45 |
| 2009/0062099 | A1 * | 3/2009 | Yamamoto et al. | 493/442 |
| 2010/0009829 | A1 * | 1/2010 | Mimura et al. | 493/434 |
| 2010/0222195 | A1 * | 9/2010 | Oota et al. | 493/442 |
| 2011/0101591 | A1 * | 5/2011 | Sano et al. | 270/20.1 |
| 2012/0004086 | A1 * | 1/2012 | Shirakura et al. | 493/454 |

FOREIGN PATENT DOCUMENTS

| | | |
|---|---|---|
| JP | 2000-044115 | 2/2000 |
| JP | 2005-231778 | 9/2005 |
| JP | 2006/076776 | 3/2006 |
| JP | 2006-076777 | 3/2006 |

* cited by examiner

*Primary Examiner* — Matthew G Marini
*Assistant Examiner* — John M Royston
(74) *Attorney, Agent, or Firm* — Manabu Kanesaka

(57) ABSTRACT

A sheet folding apparatus for forming first folding and second folding in a sheet enables the sheet to be folded in an accurate fold position in second folding, when the front end of the sheet which is first folded in a nip position of a first folding roller pair and transported strikes a stopper member, a guide member guides a fold to undergo second folding of the first-folded sheet to a nip position of a second folding roller pair, and second folding is formed.

12 Claims, 15 Drawing Sheets

SHEET FOLDING APPARATUS AND IMAGE FORMATION SYSTEM PROVIDED WITH THE APPARATUS

BACKGROUND OF THE INVENTION

1. Technical Field

The present invention relates to a sheet folding apparatus that folds a sheet with an image formed thereon, and more particularly, to a sheet folding apparatus for enabling a sheet to be folded in an accurate fold position with a simplified structure and an image formation system provided with the apparatus.

2. Description of Related Arts

Generally, this type of sheet folding apparatus has been known as an apparatus for folding a sheet with an image formed thereon by an image formation apparatus such as a printing press, printer apparatus and copier in a predetermined fold position to perform finish processing, and for example, there are an apparatus which is coupled to a sheet discharge outlet of an image formation apparatus, folds a sheet with an image formed for filing, and carries the sheet out to a subsequent binding processing apparatus and the like. The sheet folding apparatus for thus folding a sheet in half or one-third to carry out is configured as a post-processing apparatus of the image formation apparatus, or as a unit incorporated into the image formation apparatus or binding processing apparatus.

As a folding form in such a sheet folding apparatus, for example, for filing, various forms such as ½ folding, ⅓ Z-folding and ⅓ letter-folding are known corresponding to the intended use, and in forms such as ⅓ Z-folding and ⅓ letter-folding with the need of folding in three among the forms, the folding processing is performed twice.

Then, in the case of performing the folding processing twice, for first folding, since a sheet is transported while being held and regulated by the transport means, it is easy to accurately detect a fold position of first folding by measuring timing after detecting the front end of the sheet. However, in second folding, since the sheet, which is first folded and fed in a relatively free state, is nipped and second folding is formed, there is the problem that fluctuations occur in the fold position in nipping and that an accurate fold is not formed.

Therefore, there is a configuration in which the front end of the sheet transported to form second folding is struck by a stopper to add regulation to the sheet, and the sheet is thereby nipped in a certain position to perform the fold processing. However, in such a sheet folding apparatus using the stopper, since the front end of the sheet is struck by the stopper and regulated, the distance between the stopper and a folding roller pair is relatively long, and there is the problem that the sheet tends to be slack in between the stopper and the folding roller pair.

Therefore, such a configuration is known that a sensor is provided on the downstream side of a folding roller pair in the sheet transport direction, the sheet is halted by break means when the sensor detects that the sheet reaches downstream by a predetermined distance, and that a loop of the sheet occurring by continuing transport of the sheet is nipped with the folding roller pair to form the fold (for example, see Japanese Patent Application Publication No. 2000-44115).

Another configuration is known in which a roller pair capable of rotating forward and backward is provided on the downstream side of a folding roller pair, the roller pair rotates forward and holds a sheet when the front end of the sheet comes into contact with the halted roller pair, and then rotates backward this time to form a loop in the sheet, and the folding roller pair nips the loop to form the fold (for example, see Japanese Patent Application Publication No. 2006-76776).

SUMMARY OF THE INVENTION

Thus, in the conventional techniques, the loop is formed by using the break member and roller pair instead of the stopper and performing transport in the opposite direction concurrently with halting travel of the sheet in one direction. However, since there is the distance between the sheet halt/transport position and the space to form the loop, the sheet becomes unstable inside the transport path, and it is not possible to obtain sufficient fold accuracy even by these methods.

Accordingly, the present invention is to provide a sheet folding apparatus for resolving fluctuations in the fold position caused by the slack of a sheet and enabling second folding of high accuracy to be achieved while exploiting the advantage of a stopper for enabling the sheet to be regulated with reliability by the sheet striking the stopper.

According to the invention, after striking the stopper member and undergoing regulation, the sheet to undergo second folding is guided to a nip position of second-folding rollers and is thereby not slack, fluctuations therefore do not occur in a fold position of the sheet, and it is made possible to provide the fold of the sheet in the accurate and stable position.

DETAILED DESCRIPTION OF THE INVENTION

Embodiments of the invention will specifically be described below based on drawings.

Figure 1:
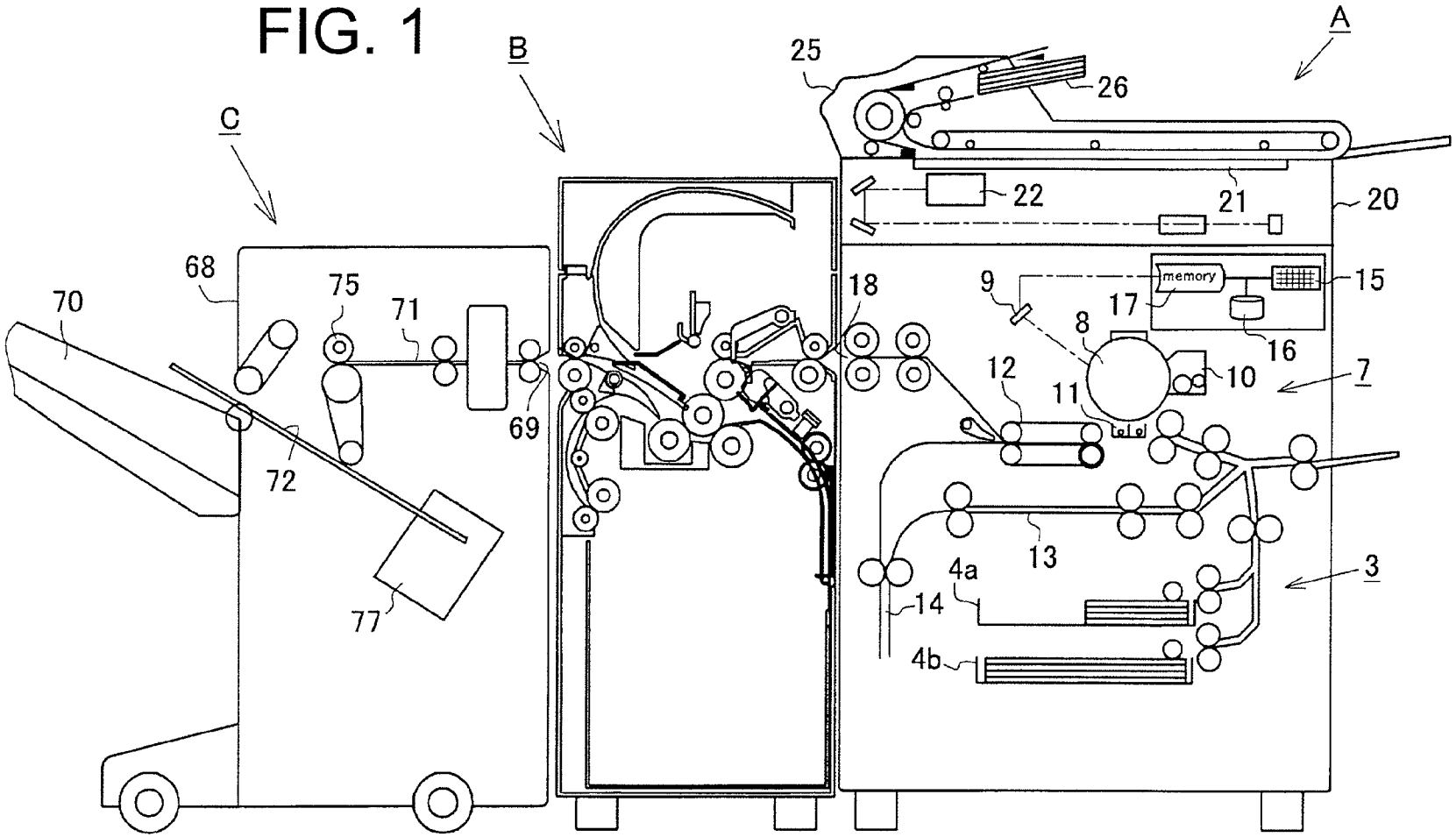
FIG. 1 shows an explanatory view of the entire configuration of an image formation system according to the invention.

FIG. 1 shows an image formation system according to the invention. This image formation system is comprised of an image formation apparatus A that is the preprocess and a post-processing apparatus C that is the post-process, and the post-processing apparatus C is installed with a sheet folding apparatus B as a unit.

The image formation apparatus A is configured as a printer, copier, printing press or the like for sequentially forming images on sheets. The apparatus as shown in the figure is comprised of an image formation section 7, original document reading section 20 and feeder section (original document feeding apparatus) 25 as a complex copying machine having the copier function and the printer function. Further, the post-processing apparatus C is coupled to a main-body sheet discharge outlet 18 of the image formation apparatus A, and is configured to perform post-processing such as folding processing, punching processing, sealing processing and binding processing on a sheet with an image formed. Then, the post-processing apparatus C is integrally provided with the folding processing unit (sheet folding apparatus) B for performing folding processing on a sheet with an image formed. The sheet folding apparatus B, image formation apparatus A and post-processing apparatus C will be described below in this order.

[Sheet Folding Apparatus]

The sheet folding apparatus B is incorporated into the image formation apparatus A or the post-processing apparatus C, or is configured as an apparatus (stand-alone configuration) independent of the apparatuses. The apparatus as shown in the figure is disposed between the image formation apparatus A and the post-processing apparatus C to constitute the image formation system. Then, the sheet folding apparatus B is attached to the post-processing apparatus C as an optional unit.

Figure 2:
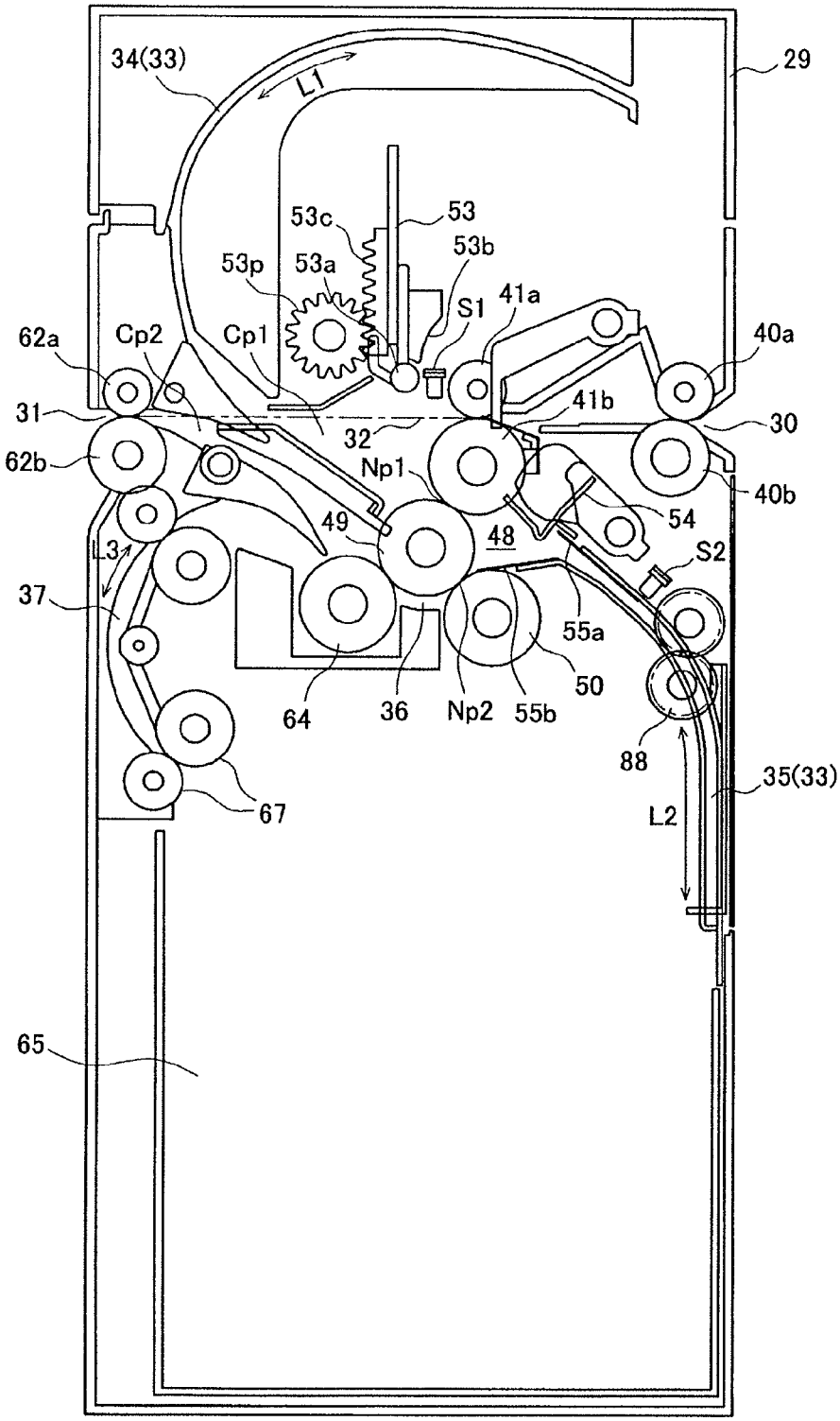
FIG. 2 shows an explanatory view of the entire configuration of a sheet folding apparatus in the system of FIG. 1.

In the sheet folding apparatus B, as shown in FIG. 2 illustrating the entire configuration, an apparatus housing 29 is provided with a carry-in entrance 30 and a carrying-out exit 31, the carry-in entrance 30 is arranged in a position continued to the main-body sheet discharge outlet 18 of the image formation apparatus A on the upstream side, and the carrying-out exit 31 is arranged in a position continued to a sheet receiving opening 69 of the post-processing apparatus C on the downstream side. The carry-in entrance 30 and carrying-out exit 31 are thus disposed opposite each other across the apparatus housing 29.

Then, in between the carry-in entrance 30 and the carrying-out exit 31 are disposed a first transport path 32 for carrying out a sheet from the carry-in entrance 30 to the carrying-out exit 31 without performing the folding processing, and a second transport path 34 and third transport path 35 for performing the folding processing on a sheet from the carry-in entrance 30 to carryout to the carrying-out exit 31. The second transport path 34 and third transport path 35 are connected to form a folding processing passage 33, and in the folding processing passage 33 are disposed a "transport mechanism" for carrying a sheet in the predetermined direction and a "folding processing mechanism" for performing the folding processing on the sheet.

[Path Configuration]

As described previously, in the apparatus housing 29, the first transport path (hereinafter, referred to as a "first path") is disposed between the carry-in entrance 30 and the carrying-out exit 31. This path may be a linear path disposed in the horizontal direction as shown in the figure, may be configured as a curved path, or may be disposed in the vertical direction, and it is possible to adopt any configuration. The first path 32 guides a sheet from the carry-in entrance 30 to the carrying-out exit 31 without performing the folding processing.

The second transport path 34 (hereinafter, referred to as a "second path") is formed to branch off substantially in the orthogonal direction to the sheet transport direction in the first transport path 32, in a branch point provided between the carry-in entrance 30 and the carrying-out exit 31. Further, the third transport path 35 (hereinafter, referred to as a "third path") is formed to branch off from the branch point substantially in the opposite direction to the sheet transport direction in the second transport path 34. In other words, the third path 35 is formed to branch off substantially in the orthogonal direction to the sheet transport direction in the first transport path 32 as in the second path 34, but branches off in the opposite direction to the sheet transport direction of the second path 34.

The folding processing passage 33 formed by the second path 34 and the third path 35 communicating with each other is a path for performing the folding processing on a sheet from the carry-in entrance 30, and folding processing means 48, described later, is disposed in a folding position Np1 (Np2). Then, the second path 34 is configured to guide the sheet front end for first folding to the folding position (first nip position described later) Np1, and the third path 35 is configured to guide the folded sheet front end to the folding position (second nip position described later) Np2 to perform second folding on the folding-processed sheet. Then, downstream of the folding processing passage 33, a fourth transport path (hereinafter, referred to as a "fourth path") 36 is continued to carry out the folded sheet from the second nip position Np2 toward the carrying-out exit 31.

The second path 34 crosses the first path 32 and guides the sheet to above the first path 32, and the third path 35 guides the sheet to below the first path 32. In the Embodiment as shown in FIG. 2, the second path 34 is disposed above the first path 32 disposed in the horizontal direction, and the third path 35 is disposed below the first path 32.

Thus, the second path 34 and the third path 35 are disposed in the direction orthogonal to the first path 32, and the second path 34 for guiding the sheet to the first folding position (first nip position described later) Np1 may be disposed below the first path 32, while the third path 35 for guiding the folding-processed sheet to the downstream side may be disposed above the first path 32.

Further, when the first path 32 is disposed in the vertical direction, it is configured that the second path 34 is disposed to the right (or left) of the first path 32, and that the third path 35 is disposed to the left (or right) of the path 32. In addition, in the Embodiment as shown in FIG. 2, in relation to guiding the folded sheet to the second nip position Np2 (see FIG. 5) to perform second folding on the sheet, the third path 35 is configured to reverse the feeding direction of the sheet, but when second folding is not performed on the sheet, the path 35 can be a path to extend straight.

The fourth path 36 for guiding the sheet which is folding-processed in the third path 35 to the carrying-out exit 31 is provided in between the second nip position Np2 for performing second folding on the sheet and the carrying-out exit 31. Downstream of the fourth path 36 is disposed a sheet discharge path 37 for guiding the folded sheet to a storage stacker from a sheet discharge outlet 51 different from the carrying-out exit 31.

Then, the second path 34 is curved in the shape of an arc opposite the top of the apparatus housing 29, and the third path 35 is curved in the shape of an arc at part of the portion opposite the side plate having the carry-in entrance 30 of the apparatus housing 29. By thus providing each of the second path 34 and the third path 35 with the curved passage portion, it is possible to maximally use space inside the apparatus, particularly, space in the height direction, and the apparatus can be made compact. For the same reason, the sheet discharge path 37 continued to the fourth path 36 is also formed of a path curved in the shape of an arc.

Then, a path length (L1) of the second path 34 for guiding a sheet from the first path 32 to the first folding position (first nip position) Np1 and a path length (L2) of the third path 35 for guiding the folded sheet subjected to first folding to the second folding position (second nip position) Np2 are configured so that path length L1>path length L2.

A path length L3 of the sheet discharge path 37 for guiding the sheet further subjected to the folding processing to the storage stacker 65 from the second nip position Np2 is configured so that L3<L2<L1. This is because when the first folding position (first nip position) Np1 is disposed near the first path 32, the path lengths are L3<L2<L1 as a result, and the path configuration is thereby made compact.

Then, in order for the sheet discharged from the first folding position (first nip position) Np1 to be guided to the third path 35 without causing a jam, a mylar 55*a* is attached to the curved portion of the third path 35 to reduce friction with the sheet.

Each of the second path 34 and the third path 35 has the curved portion as described previously, and therefore, the shape of the folding processing passage 33 is formed of a curve in the shape of an S as shown in FIG. 2. Further, the third path 35 is coupled to the storage stacker 65 by the sheet discharge path 37. Accordingly, the second path 34 with the longest path length is disposed above the first path 32, the third path 35 and the sheet discharge path 37 with the shorter path lengths are disposed below the first path 32, and the storage stacker 65 is disposed further below. By such a layout configuration, it is possible to make the inside space of the apparatus housing 29 compact.

[Folding Processing Means]

The folding processing means 48 in the folding processing passage 33 to perform the folding processing on a sheet is comprised of folding rollers 41*b*, 49, 50 for folding the sheet in two or three, and a folding deflecting member 53 and guide member 54 for changing the transport direction of the sheet to guide a fold of the sheet to the nip position Np1 (Np2). The sheet is folded in three by second folding after first folding, the folding roller 41*b* and folding roller 49 rotating in mutually opposite directions constitute a first folding roller pair 100 (FIGS. 4 and 5) for forming first folding in the sheet in the nip position Np1, and the folding roller 49 and folding roller 50 rotating also in mutually opposite directions constitute a second folding roller pair 101 (FIGS. 4 and 5) for forming second folding in the sheet in the nip position Np2.

Accordingly, in the folding processing means 48, the first folding roller pair 100 and folding deflecting member 53 constitute a folding processing mechanism (first folding), and the second folding roller pair 101 and guide member 54 constitute a second-folding processing mechanism.

[Path Switching Means]

As described above, the first path 32 and the folding processing passage 33 are disposed to cross each other, the second path 34 is disposed above the first path 32, the third path 35 is disposed below the first path 32, and the folding processing passage 33 is connected to the fourth path 36 for returning the folded sheet from the second nip position Np2 to the first path 32.

Accordingly, in these paths, as shown in FIG. 2, the first path 32 and the folding processing passage 33 cross each other in Cp1, and the fourth path 36 and the first path 32 cross each other in Cp2. Then, path switching means 63 for switching the transport direction of the sheet is disposed in the first cross portion Cp1 and the second cross portion Cp2, and is configured to guide the sheet to the second path 34 from the first path 32, guide the sheet to the third path 35 from the second path 34, and guide the sheet to the first path 32 from the fourth path 36.

Figure 3:
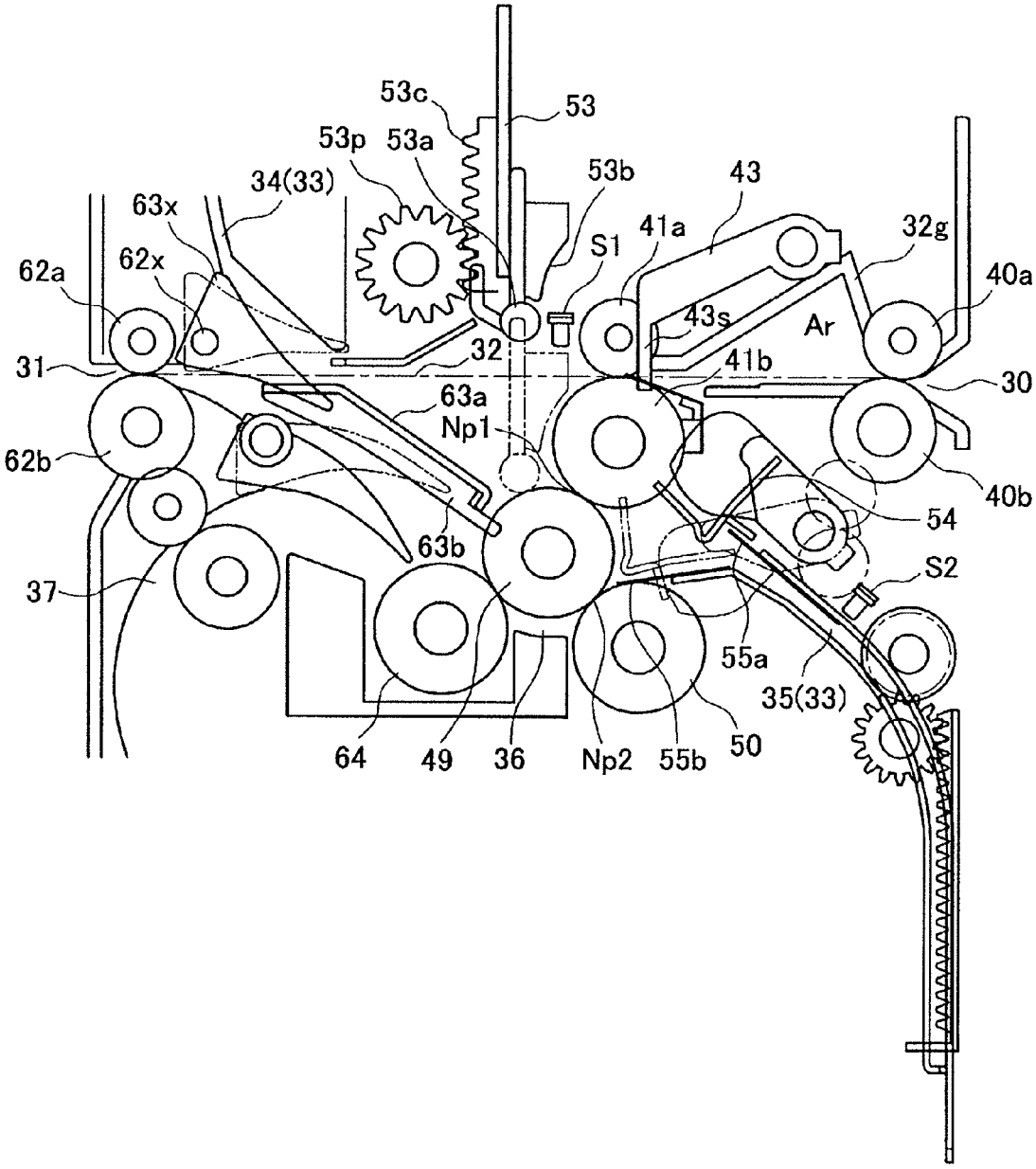
FIG. 3 shows an enlarged explanatory view of principal part in the sheet folding apparatus of FIG. 2.

As shown in FIG. 3, the path switching means 63 is axially supported at a base end portion 63*x* swingably by the apparatus frame spindle 62*x* outside the path, and has a frontside guide surface 63*a* and backside guide surface 63*b* formed in the front end portion.

Then, the frontside guide surface 63*a* guides the sheet fed to the first path 32 to the second path 34 of the folding processing passage 33 from the first path 32 in the solid-line attitude in FIG. 3. Concurrently therewith, the backside guide surface 63*b* sends the folded sheet fed to the fourth path 36 back to the first path 32. Further, the path switching means 63 directly feeds the sheet fed to the first path 32 to the carrying-out exit 31 without carrying the sheet in the folding processing passage 33 in the dashed-line attitude (only the base end portion 63*x* is shown) in FIG. 3.

Figure 10:
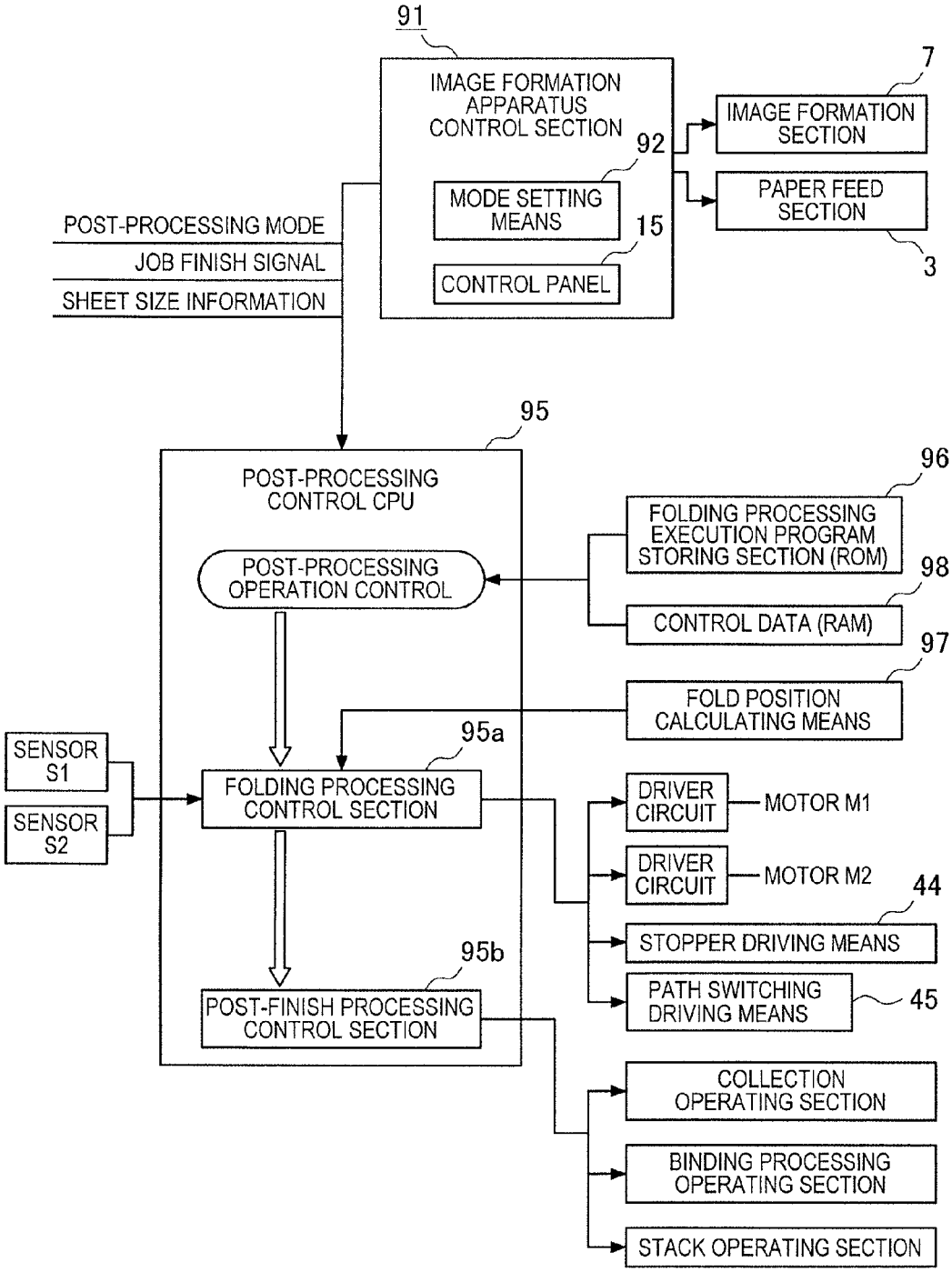
FIG. 10 illustrates a control configuration in the system of FIG. 1.

Thus, the path switching means 63 changes the attitude between the first guide attitude (dashed lines in FIG. 3) for directly feeding the sheet from the carry-in entrance 30 to the carrying-out exit 31 in the first path 32 and the second guide attitude (solid line in FIG. 3) for guiding the sheet that is fed to the first path 32 from the carry-in entrance 30 to the folding processing passage 33 while guiding the sheet fed from the fourth path 36 to the first path 32, and the change is attained by path switching driving means 45 (FIG. 10). The path switching driving means 45 is a solenoid of which driving is controlled by a folding processing control section 95*a* that will be clarified later. Accordingly, the path switching means 63 comprised of a plate-shaped piece that swings on the spindle 62*x* is coupled at the base end portion to the solenoid and return spring.

[Configuration of Folding Rollers]

As shown in FIG. 3, in the folding processing passage 33, the first roller 41*b*, second roller 49 and third roller 50 constituting the folding processing means 48 are disposed to come into press-contact with one another. The second folding roller 49 is positioned on the downstream side of the first folding roller 41*b* in the sheet transport direction of the first path 32 while being away downward from the first path 32. Then, the first folding roller 41*b* rotates in the forward direction for feeding the sheet from the carry-in entrance 30 to the carrying-out exit 31, the second folding roller 49 rotates in the opposite direction, and the third folding roller 50 rotates in the forward direction. Further, the first nip position (first folding position) Np1 for first folding the sheet is formed in a press-contact point between the first folding roller 41*b* and second folding roller 49, and the second nip position (second folding position) Np2 for second folding the sheet is formed in a press-contact point between the second folding roller 49 and the third folding roller 50.

Particularly, in the apparatus as shown in the figure, the periphery of the first folding roller 41*b* is disposed in a position facing the first path 32, and a pinch roller (floating roller) 41*a* is brought into press-contact with the roller periphery. By this means, the sheet in the first path 32 is transported by the first folding roller 41*b* and the pinch roller 41*a*, and it is not necessary to provide a particular transport member and its driving mechanism in the first path 32. Further, the second folding roller 49 is brought into press-contact with a folding enhancement roller (driving roller) 64 on the downstream side of the press-contact point with the third folding roller 50.

[Configuration of the Folding Deflecting Means]

Described are configurations of the deflecting member 53 and the guide member 54 that are the folding deflecting means constituting the folding processing means 48 together with the folding rollers (41*b*, 49, 50). In three folding rollers (41*b*, 49, 50), the folding deflecting member 53 is disposed in the first nip position Np1, the guide member 54 is disposed in the second nip position Np2, and each member guides a fold of the sheet to the respective nip position (press-contact point). As shown in FIG. 3, the folding deflecting member 53 is comprised of a driven roller 53*a*, guide 53*b* and rack 53*c*.

The first nip position Np1 for first folding the sheet is formed by the first folding pair 100 comprised of the first folding roller 41*b* disposed on the upstream side, and the second folding roller 49 disposed on the downstream side. The driven roller 53*a* is disposed in a position coming into contact with the periphery of the second folding roller 49 at the time of operation shown by dashed lines. Then, the guide 53*b* is provided with a curved guide surface in accordance with the periphery of the first folding roller 41*b* positioned on the upstream side.

Then, the folding deflecting member 53 is supported on a guide rail, and reciprocates in the up/down direction by forward and backward rotation of a pinion 53*p* meshing with the rack 53*c*, and the driven roller 53*a* moves up and down between an operating position (dashed-line position in FIG. 3) in which the driven roller 53*a* comes into contact with the periphery of the second folding roller 49, and a waiting position (solid-line position in FIG. 3) in which the driven roller 53*a* retracts out of the folding processing passage 33.

The sheet introduced from the carry-in entrance 30 to undergo the folding processing is nipped by the first folding roller 41*b* and the pinch roller 41*a* in press-contact with the roller 41*b* and fed out. Then, when the driven roller 53*a* comes into press-contact with the second folding roller 49 positioned on the downstream side by a descent of the folding deflecting member 53, the front end portion of the sheet fed out of the first folding roller 41*b* and the pinch roller 41*a* undergoes a transport force in the opposite direction from the driven roller 53*a* and the second folding roller 49 with respect to the guide 53*b*, while the rear end portion of the sheet newly fed out of the first folding roller 41*b* and the pinch roller 41*a* is guided by the guide 53*b* and moves toward the nip position Np1, and therefore, the sheet is guided to the first nip position Np1 along the periphery of the second folding roller 49 while forming a loop in the entire sheet. Then, the loop is nipped by the first folding roller 41*a* and the pinch roller 41*a*, and the fold is thereby formed in the sheet.

Meanwhile, the guide member 54 has a projection portion corresponding to the nip position to guide the sheet to the nip position Np2 of the second folding roller pair 101, has substantially the shape of a triangle such that both sides extending from the projection portion conform to outer peripheries of respective opposite second folding roller 49 and third folding roller 50, and as shown in FIG. 3, is configured to be movable between a waiting position and an operating position. By this means, by the guide member 54 moving from the waiting position to the operating position, the sheet with first folding formed in the first folding roller pair 100 is guided to the nip Np2 position of the second folding roller pair 101, and second folding is formed thereon.

As is clarified later, a stopper member 86 regulates the sheet, the sheet thereby forms a loop inside space formed by the outer peripheries of the second folding roller 49 and third folding roller 50, the guide member 54 guides the loop to the nip position Np2, and second folding is thereby performed on the sheet.

Further, to enable the sheet to move toward the nip Np2 position smoothly, a mylar 55*b* is attached to the front end portion of the passage wall facing the second folding roller pair 101 in the third path 35.

Figure 4:
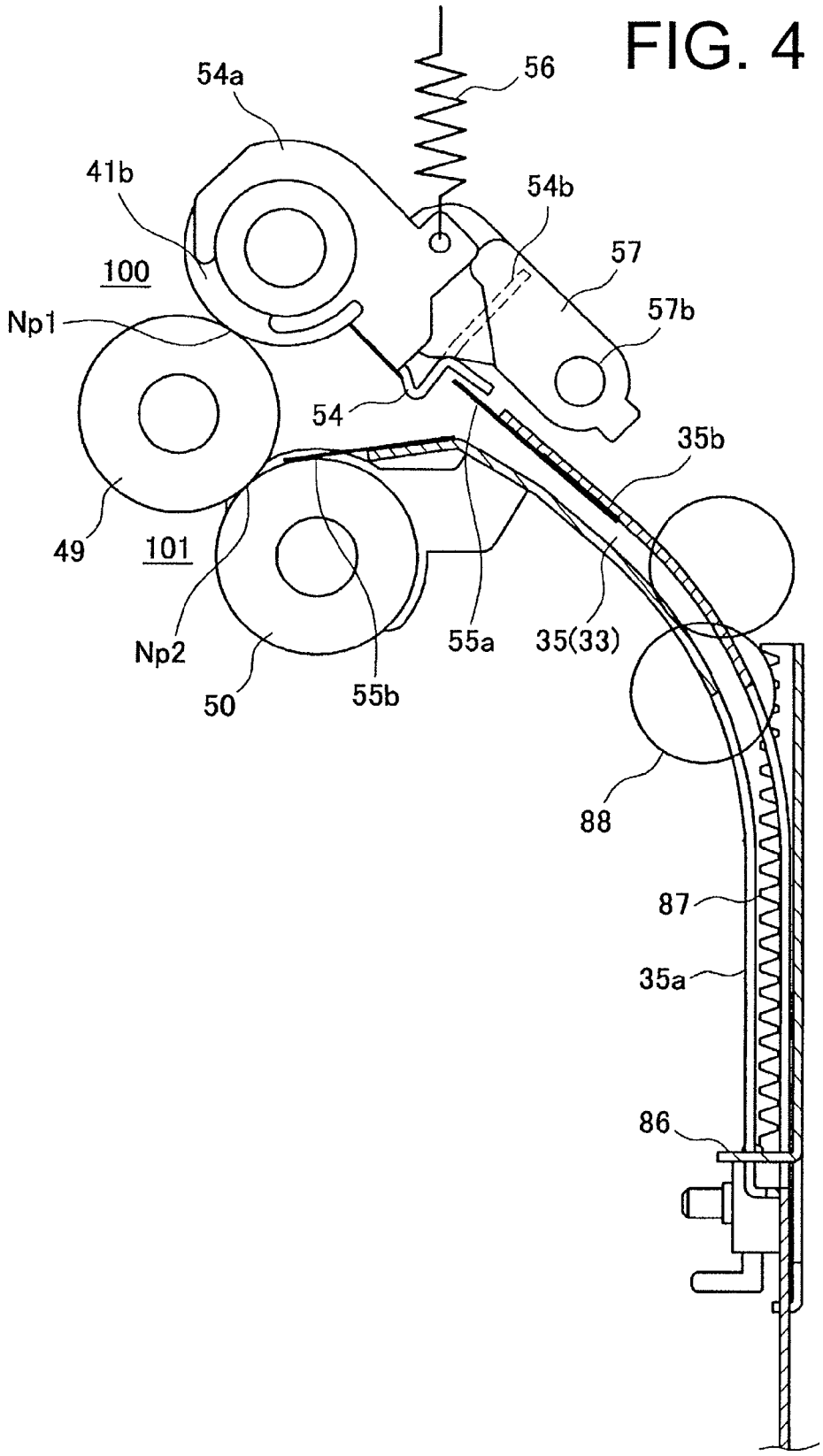
FIG. 4 shows an explanatory view of folding rollers and a guide member in a waiting position.
Figure 5:
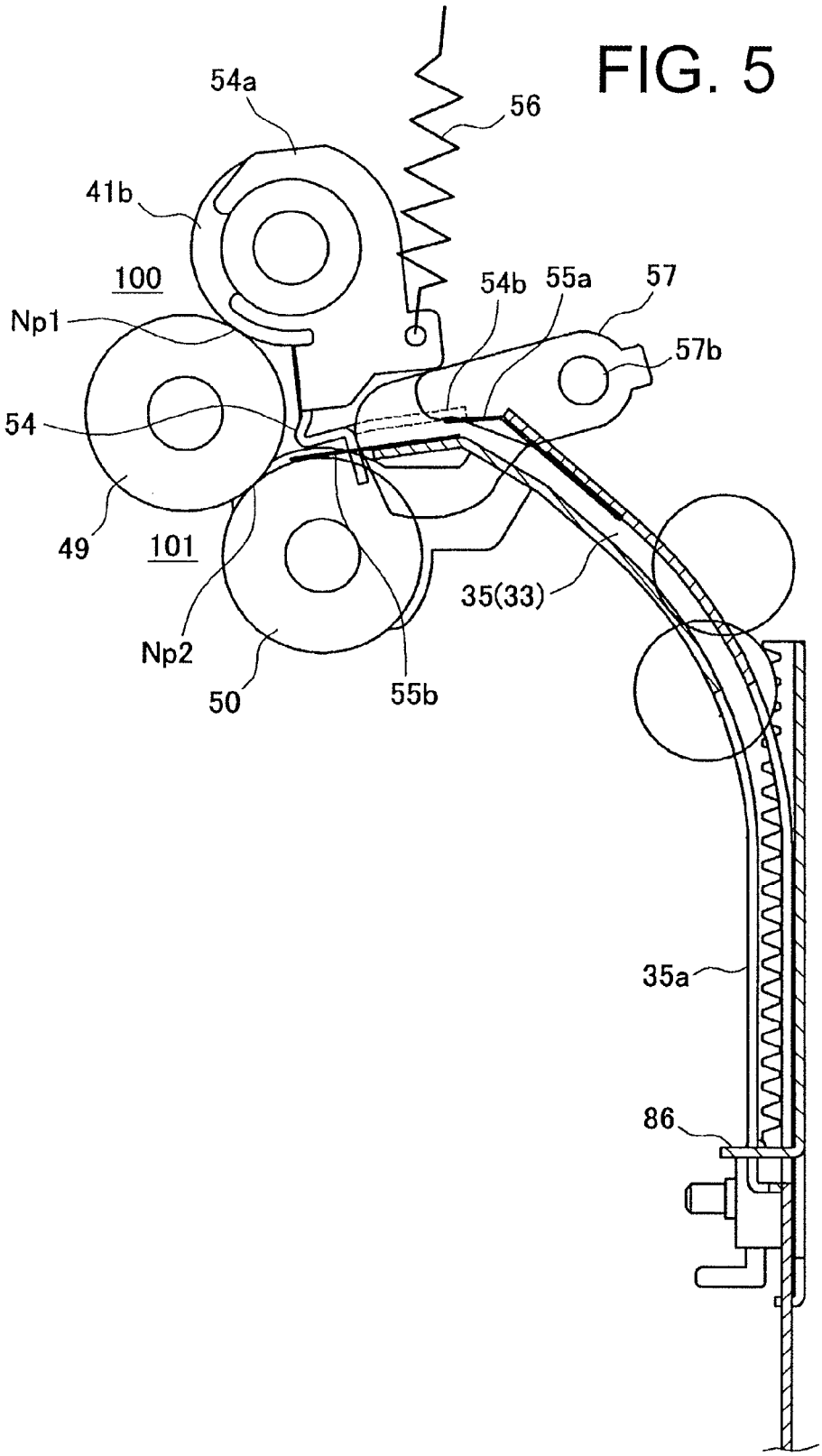
FIG. 5 shows an explanatory view of the folding rollers and the guide member in an operating position.
Figure 6:
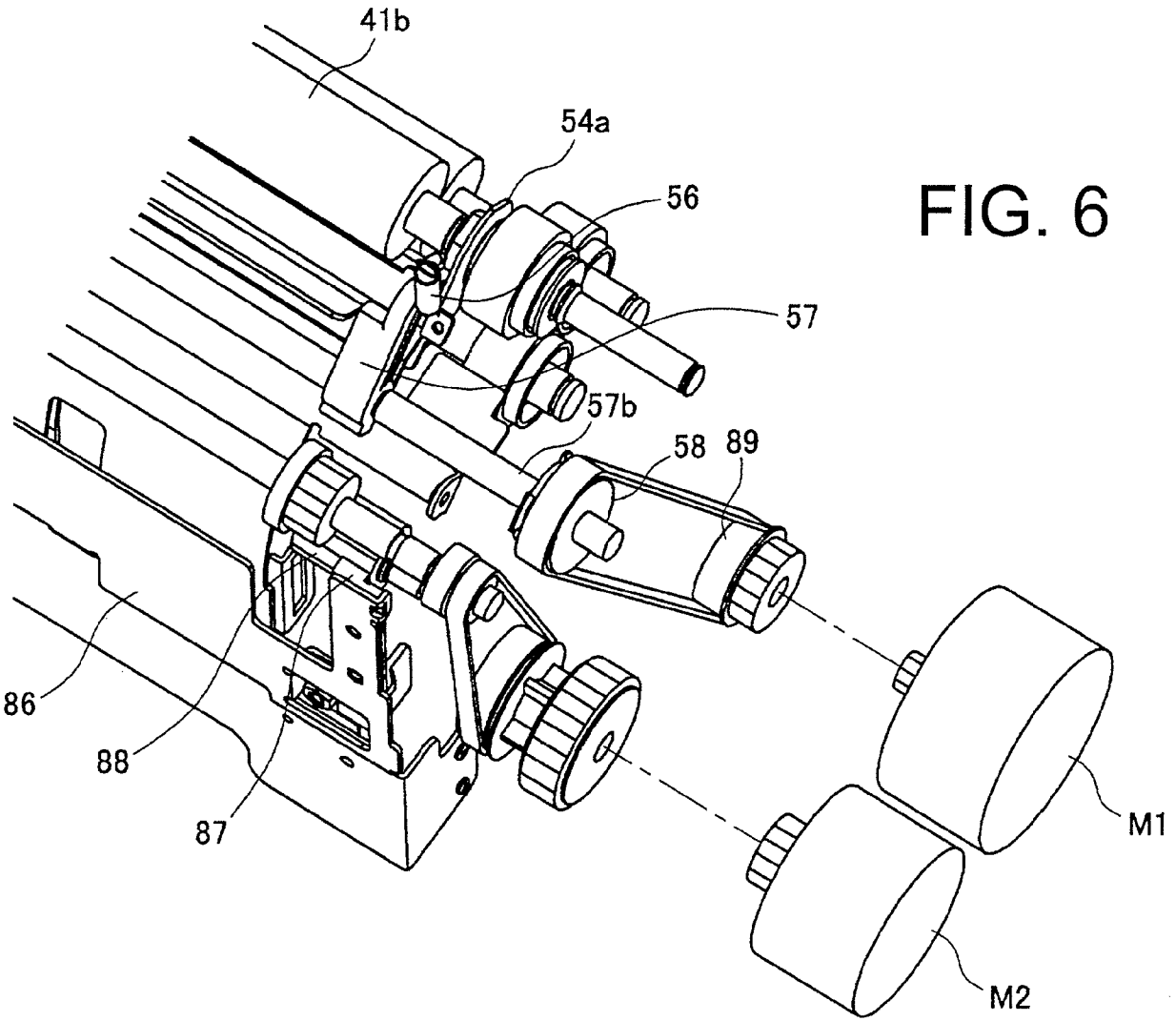
FIG. 6 shows a schematic expletory view of respective driving mechanisms of the guide member and a stopper member.

As shown in FIGS. 4, 5 and 6, the guide member 54 is attached to a rotating plate 54*a* axially supported by a rotating shaft of the first folding roller 41*b* to be rotatable on the shaft, while the rotating plate 54*a* is biased in the direction in which the guide member 54 is positioned in the waiting position by a spring 56. Then, the guide member 54 has a contact piece 54*b*, and by pressing the contact piece 54*b* against a biasing force of the spring 56 by a cam 57, moves toward the nip Np2 position of the second folding roller pair 101 to arrive at the operating position.

A free wheel 58 is attached to a rotating shaft 57*b* of the cam 57, and the cam 57 is coupled to a driving shaft of a motor M1 via a pulley 89 and gear group (not shown) in which a belt is laid across the pulley and the free wheel 58. Accordingly, by driving of the motor M1, the cam 57 presses the contact piece 54*b* to shift the guide member 54 to the operating position. Then, when driving of the motor M1 is halted, the rotating plate 54*a* rotates by a return force of the spring 56 and the guide member 54 returns to the waiting position, without loads being imposed from the motor M1 side due to the free wheel 58. Concurrently therewith, the cam 57 returns to the state for starting pressing the contact piece 54*b*. In addition, the motor M1 supplies driving power of each driving mechanism described below via the above-mentioned gear group other than driving of the cam 57.

[Driving Mechanism]

Described next is the driving mechanism of the first path 32, folding processing passage 33 and folding processing means 48 as described above. In the first path 32, the roller 40*b* is disposed on the carry-in entrance 30 side, a roller 62*b* is disposed on the carrying-out exit 31 side, and the above-mentioned folding roller 41*b* is disposed at midpoint between the rollers 40*b* and 62*b*. The rollers 40*b*, 62*b* and 41*b* are coupled to the driving shaft of the same motor via respective gears. Then, the roller 40*a* comes into press-contact with the roller 40*b* to be driven to rotate, the pinch roller 41*a* comes into press-contact with the folding roller 41*b* to be driven to rotate, and the roller 62*a* comes into press-contact with the roller 62*b* to be driven to rotate.

The second path 34 and third path 35 forming the folding processing passage 33 are not provided with transport means such as a roller and belt for providing the sheet with the transport force. Then, the second path 34 is configured so that the first folding roller 41*b* and the pinch roller 41*a* in press-contact with the roller 41*b* provide the transport force in the carry-in direction for carrying the sheet into the path, and that the second folding roller 49 and the driven roller 53*a* in press-contact with the roller 49 provide the transport force for shifting the sheet from the path to the first folding position Np1.

Meanwhile, the third path 35 is configured so that the transport force for carrying the sheet into the path is provided in the nip position of the first folding roller 41*b* and second folding roller 49, and that the transport force for feeding the sheet to the second folding position Np2 from the path is provided by the guide member 54. In the fourth path 36 continued from the third path 35, as shown in FIG. 3, the folding enhancement roller 64 in press-contact with the second folding roller 49 provides the transport force for carrying out the folded sheet toward rollers 62*a*, 62*b* of the carrying-out exit 31. Accordingly, any transport means provided with a particular driving mechanism is not disposed in the fourth path 36 either.

Further, in the above-mentioned fourth path 36 is disposed the sheet discharge path 37 for guiding the three-folded sheet to the storage stacker 65 without carrying to the carrying-out exit 31, and a sheet discharge roller 67 is provided in the path 37.

[Sheet Front End Detecting Sensor]

As described above, a first sensor S1 for detecting an end edge of a sheet is disposed in the first path 32, and detects the end edge (front end and rear end) of the sheet to carry in the second path 34. Further, in the third path 35 is disposed a second sensor S2 for detecting the end edge of the sheet to carry in. The sensors S1 and S2 detect the end edge of the sheet to calculate the fold position of the sheet, and the action of the sensors will be described later together with the folding form.

[Stopper Member]

The sheet with first folding formed by the first folding roller pair 100 is sent to the third path 35, and then, second folding is formed on the sheet by the second folding roller pair 101. To regulate the position of the sheet to form an accurate fold, the stopper member 86 is provided inside the third path 35 in order for the front end of the moving sheet to strike the member 86.

Figure 7:
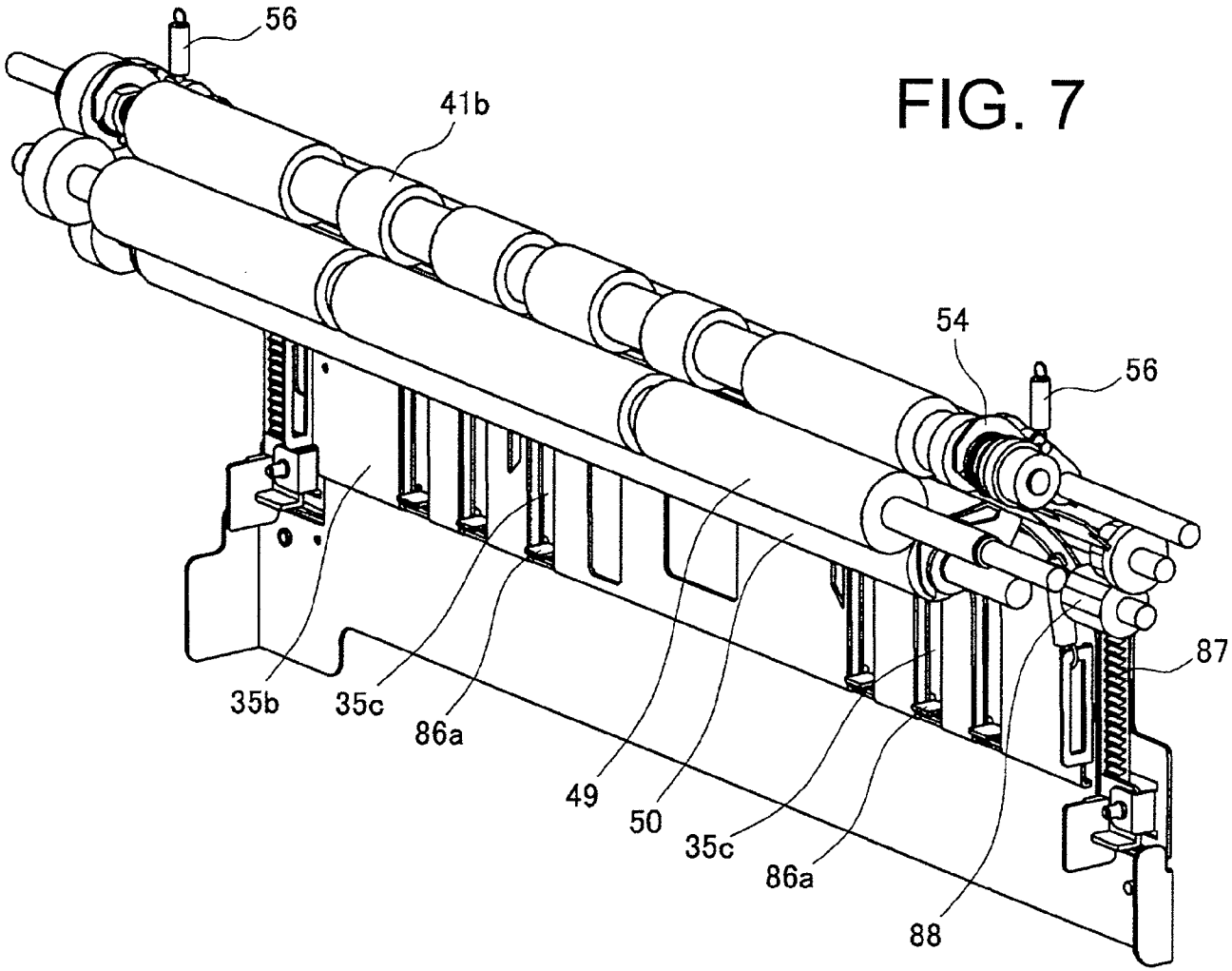
FIG. 7 shows a perspective view to explain the arrangement configuration of three folding rollers, the guide member and the stopper member.
Figure 8:
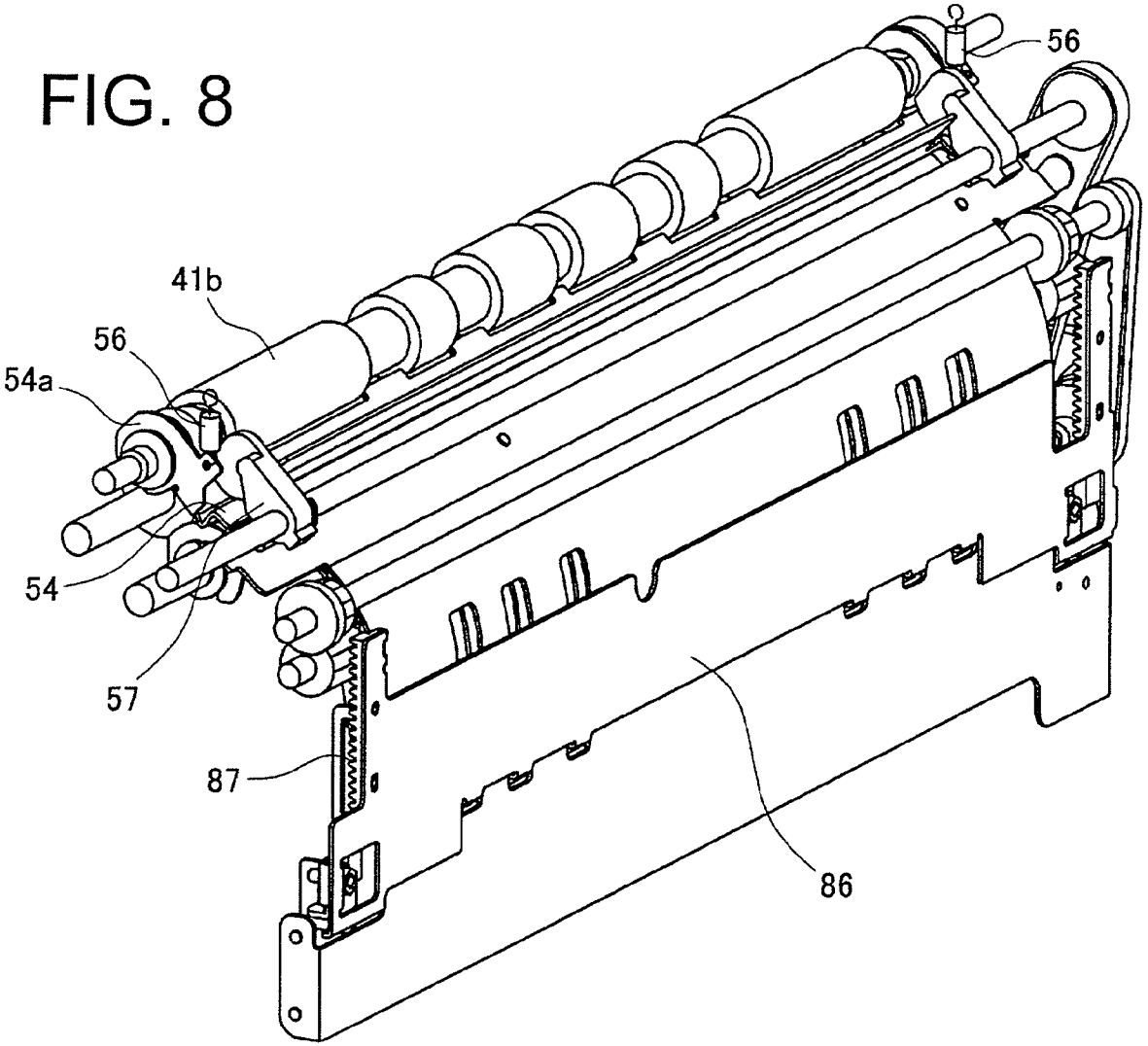
FIG. 8 shows a view to explain FIG. 7 from the back.

In the stopper member 86, as shown in FIG. 7, to support the entire width of the front end face in the moving direction of the sheet transported inside the third path 35, hooks 86*a* are protruded to the inside of the third path 35 through a plurality of long holes 35*c* formed in a partition wall 35*b* constituting the third path 35. The sheet strikes the hooks 86*a* of the stopper member 86, and the position of the sheet is thereby regulated. By the regulation, the sheet forms a loop inside the third path 35, and the guide member 54 moves from the waiting position to the operating position to guide the sheet to the nip position Np2 in a manner for chasing the loop.

At this point, the guide member 54 has the projection portion, has substantially the shape of a triangle such that both sides extending from the projection portion conform to outer peripheries of respective opposite second folding roller 49 and third folding roller 50, thereby becomes a wedge into the space formed by the outer peripheries of the second folding roller 49 and third folding roller 50 when the member 54 moves to the operating position, and narrows the space for the sheet to form a loop. By this means, the sheet always forms a certain loop, the guide member 54 guides the sheet to the nip position Np2 of the second folding roller pair 101 with the accurate fold position, and it is possible to perform second folding of high accuracy.

Since the fold position of the sheet varies with sizes of sheets and forms of the folding processing, the stopper member 86 moves according to the conditions to make the position variable, inside a linear passage portion 35*a* formed along the direction substantially orthogonal to the sheet transport direction by the first transport path 32 in the third path 35. In other words, the stopper member 86 is attached to a rack 87 provided to be movable in the vertical direction along the linear passage portion 35*a*, and is able to vary the contact position with the sheet front end within the range of the linear passage portion 35*a* of the third path 35 by traveling of the rack 87 accompanying rotation of the pinion 88. Accordingly, by controlling forward and backward rotation and the number of revolutions of a motor M2 of the pinion 88 corresponding to the size of a sheet and the form of folding processing, the front end of the sheet is capable of striking the stopper member 86 in a position adequate for the conditions.

[Register Mechanism]

In the first path 32, a register mechanism is disposed in between the carry-in roller pair 40*a*, 40*b* and the pinch roller 41*a*. The register mechanism is configured by providing a register member 43 provided with a regulation surface 43*s* for striking the sheet front end to lock and a register area Ar (space) for curving and deforming the sheet in between the carry-in roller 40*b* and the first folding roller 41*b*. The register member 43 is axially supported at the base end portion by the apparatus frame so as to swing on the spindle 43*x*, and in the front end portion is formed the regulation surface 43*s* for locking the sheet front end moving in the first path 32.

When the swingable register member 43 is in a state as shown in FIG. 3, since the member 43 inhibits travel of the sheet moving in the first path 32, the sheet fed out of the carry-in rollers 40*a*, 40*b* loses its way, and is curved in the shape of a loop inside the register area Ar formed by a sheet guide plate 32*g* constituting the first path 32. By this means, skew is corrected where the skew is a state that the sheet causes misalignment with respect to the traveling direction.

When the register member 43 is swung upward from this state, inhibition on the sheet by the regulation surface 43*s* is released, and the front end of the sheet is guided to the nip position of the pinch roller 41*a* and the folding roller 41*b*.

[Folding Processing Form]

Figure 9A:
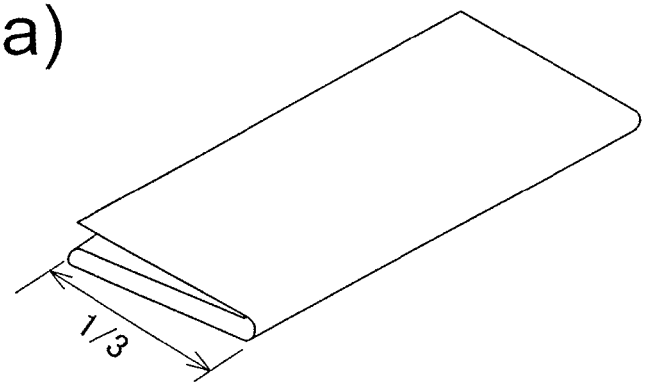
FIG. 9 contains explanatory views of sheet folding forms in the sheet folding apparatus of the invention, where FIG. 9(*a*) shows an aspect for performing inward three-folding on the sheet in a ⅓ position, FIG. 9(*b*) shows an aspect for performing Z-folding on the sheet in a ⅓ position, and FIG. 9(*c*) shows an aspect for performing Z-folding on the sheet in a ¼ position.
Figure 9B:
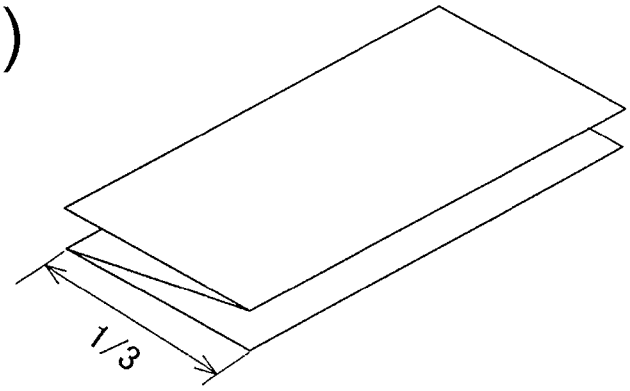
Figure 9C:
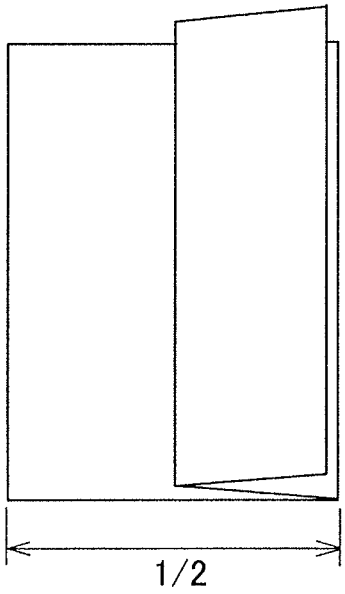

A sheet folding method by the above-mentioned folding processing means 48 will be described next according to FIG. 9. In a normal sheet with the image formed, there are cases that the sheet is folded in two or three with a binding margin left for a filing finish, and that the sheet is folded in two or three for a letter finish. Further, in folding in three, there are cases of z-folding and inward three-folding. FIG. 9(*a*) shows inward three-folding, FIG. 9(*b*) shows ⅓ Z-folding, and FIG. 9(*c*) shows ¼ Z-folding.

Then, in the case of two-folding, the sheet fed to the folding processing passage 33 is folded in a ½ position of the sheet size or in a ½ position with a binding margin left in the sheet end portion by the first folding roller pair 100 (first folding).

Meanwhile, in the case of three-folding, the sheet fed to the folding processing passage 33 is folded in a ⅓ position of the sheet size or in a ⅓ position with a binding margin left in the sheet end portion by the first folding roller pair 100 (first folding). The second folding roller pair 101 folds the remaining sheet in a ⅓ position of the folded sheet (second folding) to feed to the fourth path 36.

At this point, in the case of three-folding, when inward three-folding is performed as shown in FIG. 9(*a*), the sheet fed to the folding processing passage 33 is folded in a ⅓ position on the sheet rear end side by the first folding roller pair 100 and next, is folded in a ⅓ position on the sheet front end side. Similarly, in the case of ⅓ Z-folding as shown in FIG. 9(*b*), the sheet fed to the folding processing passage 33 is folded in a ⅓ position on the sheet front end side by the first folding roller pair 101 and next, is folded in a ⅓ position on the sheet rear end side.

Further, in the case of three-folding, when z-folding is made in a ¼ position as shown in FIG. 9(*c*), the sheet fed to the folding processing passage 33 is folded in a ¼ position on the sheet rear end side by the first folding roller pair 100 and next, is folded in a ½ position of the sheet.

[Control Means]

A configuration of the control means for above-mentioned sheet folding will be described. The sheet folding apparatus B as described previously is mounted with a control CPU, or a control section of the image formation apparatus A is provided with a folding processing control section. Then, the control section is configured to enable the following operation.

The operation will be described according to the control block diagram shown in FIG. 10. In the image formation apparatus A, a control CPU 91 is provided with a control panel 15 and mode setting means 92. The control CPU 91 controls a paper feed section 3 and image formation section 7, corresponding to image formation conditions set in the control panel 15. Then, the control CPU 91 transfers data and commands such as "post-processing mode", "job finish signal" and "sheet size information" required for post-processing to a control section 95 of the post-processing apparatus C.

The control section 95 of the post-processing apparatus C is a control CPU, and is provided with a "folding processing control section 95*a*" and "post-finish processing control section 95*b*". The folding processing control section 95*a* is comprised of fold position calculating means 97, a driver circuit for the motor M1 and a driver circuit for the motor M2. Detection signals of the sensors S1 and S2 are conveyed to the control CPU 95. Meanwhile, the control CPU 95 conveys "ON"/"OFF" control signals to the path switching means 63.

Then, for the control CPU 95, folding processing execution programs are stored in ROM 96 to control the motors M1 and M2 and path switching means 63 so as to execute the folding forms as described previously. Further, RAM 98 stores data to calculate the fold of the sheet in the fold position calculating means 97, and operation timing time of the motor M2 as data.

The fold position calculating means 97 is comprised of a computing circuit for calculating a fold position (dimension) from the sheet front end (front end in the sheet discharge direction), from the "sheet length size", "folding form" and "binding margin dimension". For example, in the two-folding mode, the sheet is folded in a ½ position in the sheet discharge direction, or is folded in a ½ position with a beforehand set binding margin left. For example, calculation of the fold position is obtained by calculating [{(sheet length size)–(binding margin)}/2].

Further, in the three-folding mode, for example, the fold position is calculated corresponding to the folding form such as letter folding (inward three-folding, ⅓ Z-folding) and filing folding (¼ Z-folding, ⅓ Z-folding).

[Folding Processing Operation]

Figure 11:
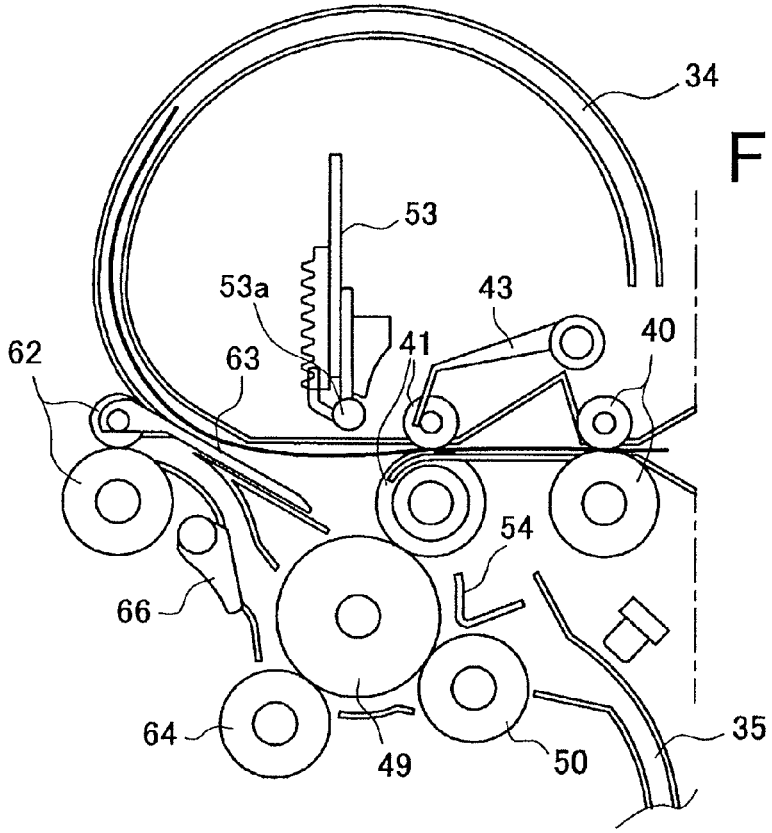
FIG. 11 is a state explanatory view of sheet folding operation in the apparatus of FIG. 2, and illustrates a state in which a sheet is carried in a second path.
Figure 12:
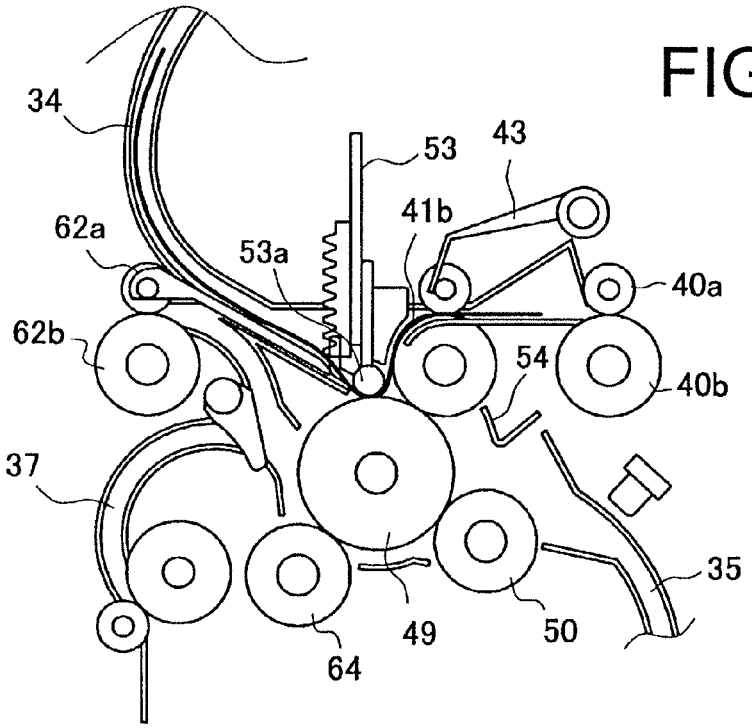
FIG. 12 is another state explanatory view of sheet folding operation in the apparatus of FIG. 2, and illustrates a state in which the sheet is first folded in a first nip position.
Figure 13:
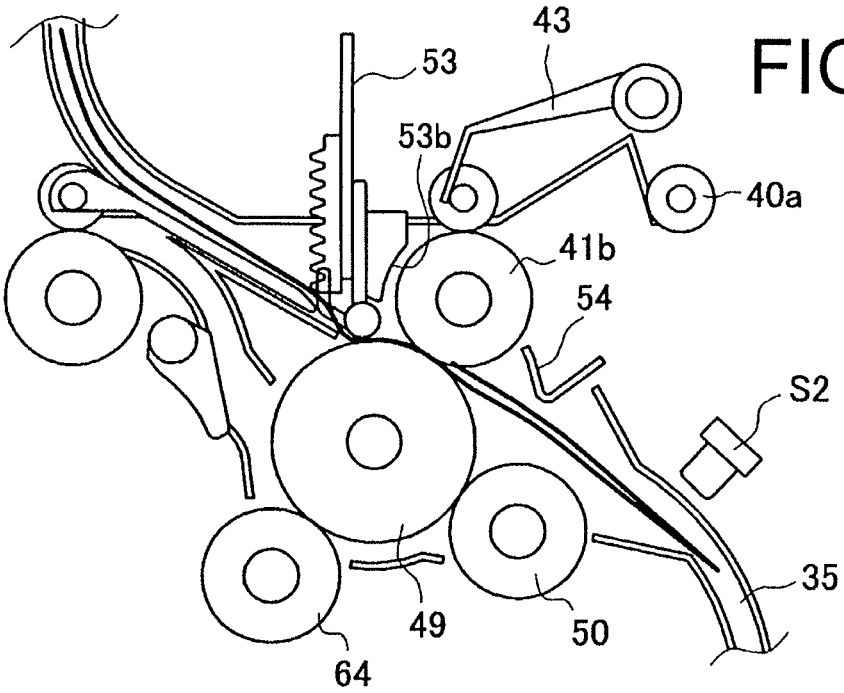
FIG. 13 is still another state explanatory view of sheet folding operation in the apparatus of FIG. 2, and illustrates a state in which the first-folded sheet is carried in a third path.
Figure 14:
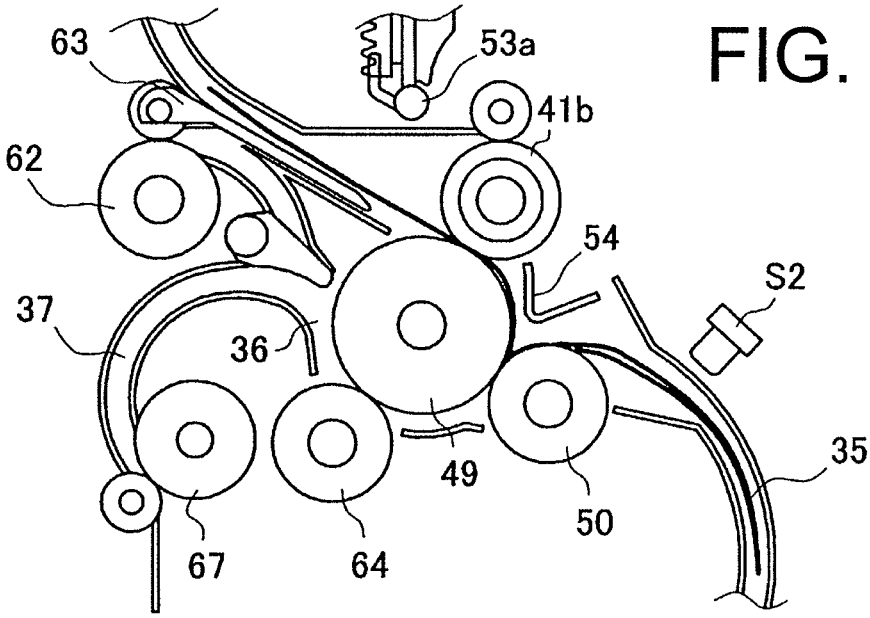
FIG. 14 is still another state explanatory view of sheet folding operation in the apparatus of FIG. 2, and illustrates a state in which the sheet from the third path is folded in a second nip position.
Figure 15:
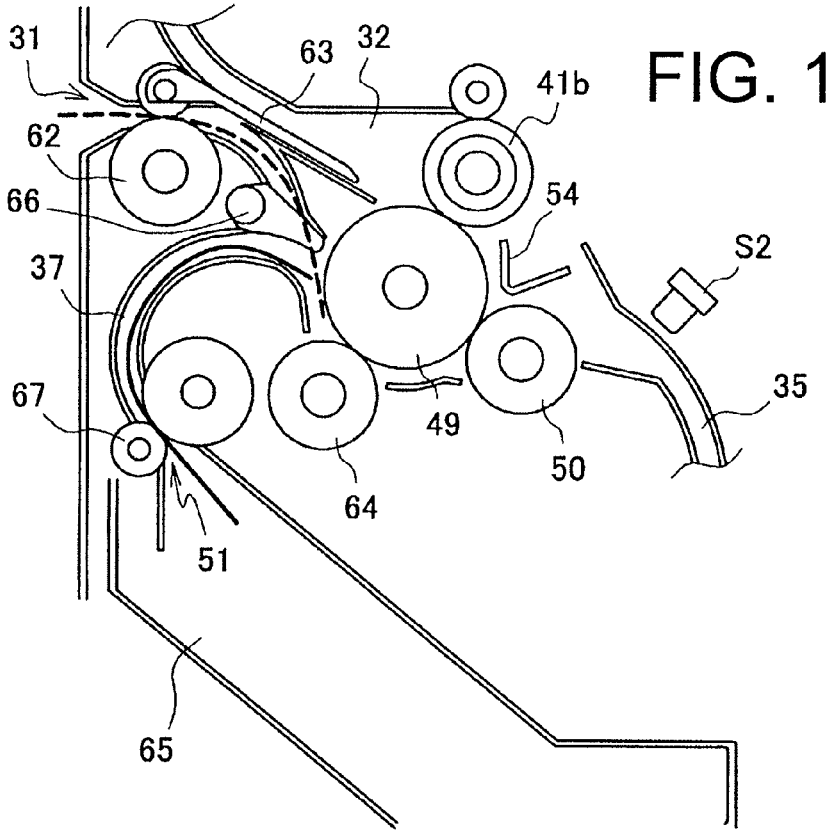
FIG. 15 is still another state explanatory view of sheet folding operation in the apparatus of FIG. 2, and illustrates a state in which the sheet folded in the second nip position is carried out in the sheet discharge direction.
Figure 16:
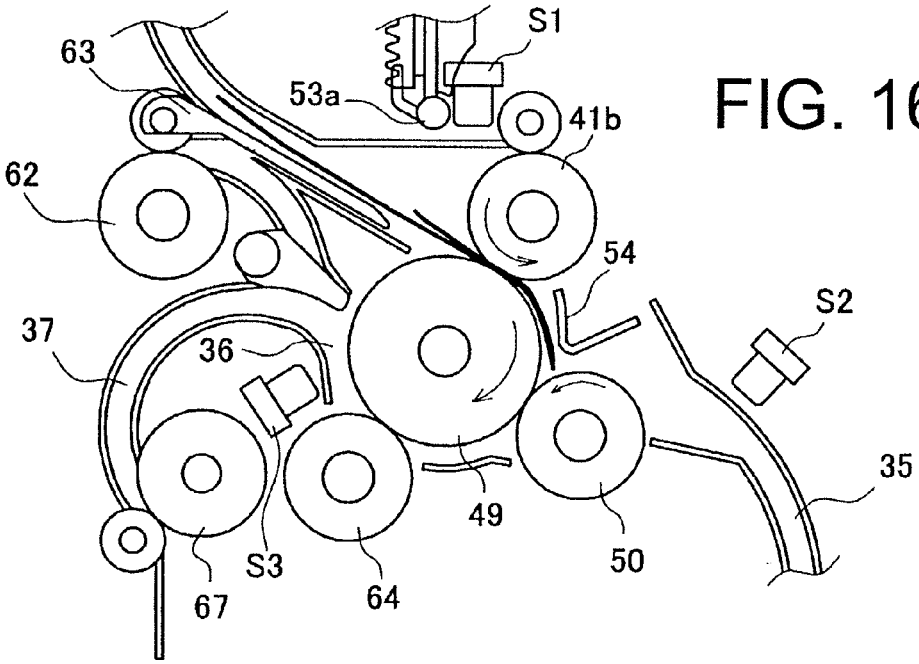
FIG. 16 is still another state explanatory view of sheet folding operation in the apparatus of FIG. 2, and illustrates action of the guide member for guiding the sheet front end to the second nip position in performing a second folding mode.
Figure 17:
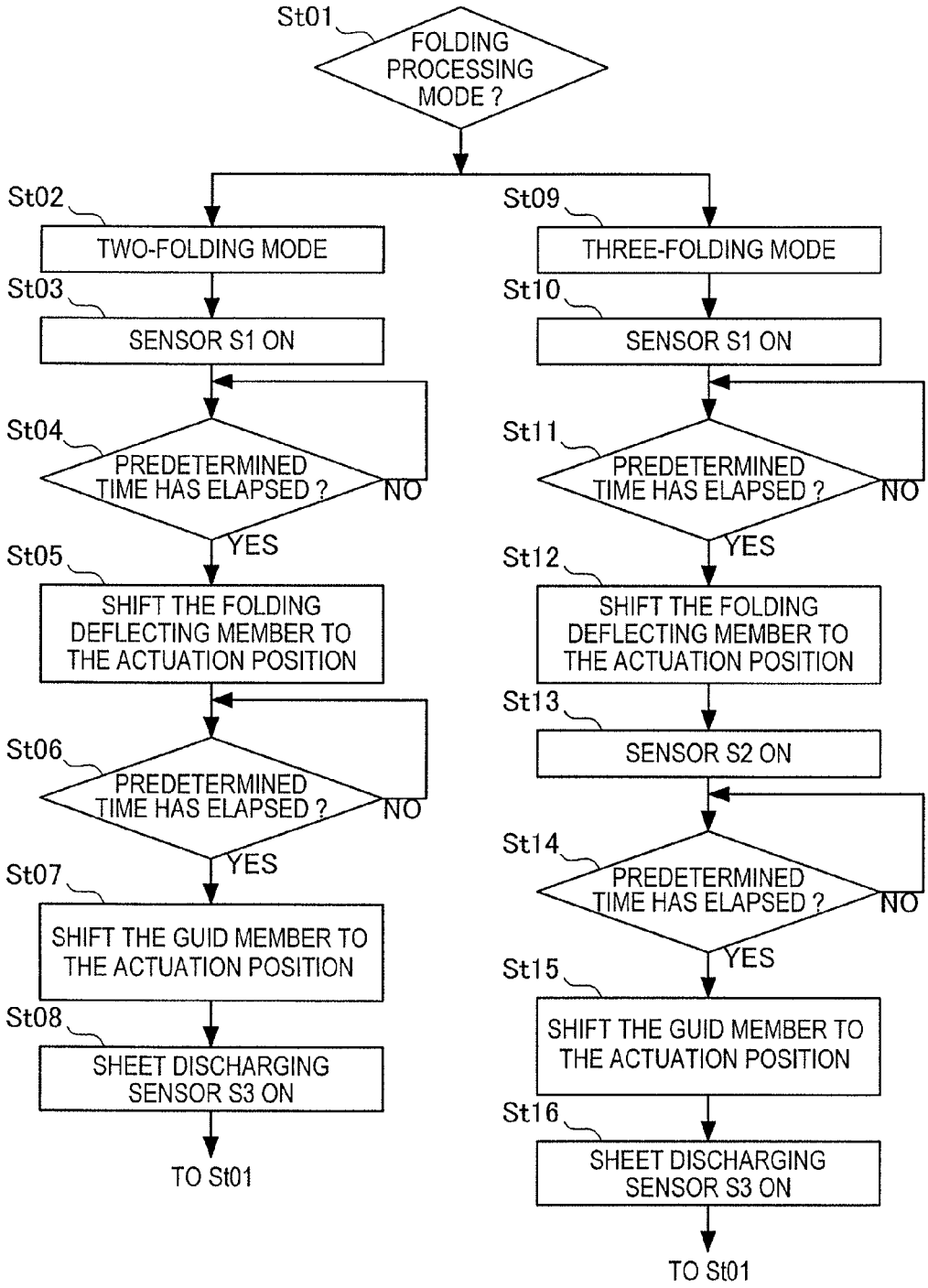
FIG. 17 shows a flowchart illustrating fold processing operation by the apparatus of FIG. 2.

The action in the configuration of the above-mentioned sheet folding apparatus B will be described. FIG. 11 illustrates a state in which a sheet is carried in the second path 34 for first folding, FIG. 12 illustrates a state in which the sheet is folded in the first folding position Np1, FIG. 13 illustrates a state in which the folded sheet is carried in the third path 35, FIG. 14 illustrates a state in which the sheet is folded in the second folding position Np2, and FIG. 15 illustrates a state in which the folded sheet is carried out. Further, FIG. 16 is an operation state view showing folding operation in the two-folding mode, and FIG. 17 is a flow diagram of the control operation.

FIG. 11 illustrates a state in which the sheet guided to the carry-in entrance 30 is fed to the downstream side by the carry-in roller pair (first transport means) 40, and is guided to the second path 34 from the first path 32 after skew is corrected in the register mechanism as described previously. In addition, the operation of the register mechanism at this point is attained by the folding processing control section 95*a* controlling stopper driving means 44. When the sheet is carried in the second path 34 by second transport means 41, the sheet sensor S1 detects the sheet front end to carry in the second path 34.

In FIG. 12, based on a signal such that the sheet sensor S1 detects the sheet front end, the folding processing control section 95*a* shifts the folding deflecting member 53 from the waiting position to the operating position at timing at which the fold position of the sheet is carried to a predetermined position. Thus, the sheet in the first path 32 is deformed in the shape of a V toward the first nip position Np1. Then, when the driven roller 53*a* attached to the folding deflecting member 53 comes into press-contact with the periphery of the second folding roller 49, the sheet front end side is fed in the opposite direction (rotation direction of the second folding roller).

Meanwhile, the sheet rear end side feeds the sheet toward the first nip position Np1 by the transport force of the second transport means 41. At this point, the curved guide surface of the guide 53*b* regulates the sheet to follow the roller periphery of the first folding roller 41*b*.

Accordingly, to the first folding position Np1, the sheet is fed toward the first nip position Np1 on the front and side by the driven roller 53*a* and on the rear end side by the second transport means 41, and up-and-down timing of the folding deflecting member 53 is to calculate the fold position. Therefore, the folding processing control section 95*a* beforehand sets the velocity for carrying the sheet by the second transport means 41 and the timing (particularly, timing at which the roller comes into contact with the periphery of the second folding roller 49) for shifting the driven roller 53*a* to the operating position from the waiting position at optimal values by experiments.

Then, the curved guide surface of the guide 53*b* guides the sheet to follow the periphery of the opposed first folding roller 41*b* in synchronization with the shift of the driven roller 53*a* from the waiting position to the operating position, and therefore, there is no fear that the fold position of the sheet changes every time.

In FIG. 13, the sheet first-folded in the ½ position (two-folding), ⅓ position (three-folding) or ¼ position (three-folding) in the first nip position Np1 is provided with the transport force by the first nip position Np1 and fed to the downstream side, corresponding to timing at which the folding deflecting member 53 moves to the operating position.

Then, the folding processing control section 95*a* controls the motor M1 to position the guide 54 in the operating position in the two-folding mode, or in the waiting position in the three-folding mode. FIG. 13 shows control of the three-folding mode. In two-folding, the guide member 54 is positioned in the operating position, and the folded sheet is guided to the second nip position Np2 beginning with the front end, and is fed to the carrying-out exit 31 on the downstream side.

In the three-folding mode, the folding processing control section 95*a* positions the guide member 54 in the waiting position as shown in FIG. 13. Thus, the sheet fed from the first nip position Np1 is fed to the third path 35 beginning with the front end. The folding processing control section 95*a* detects that the first-folded sheet is fed to the third path 35 with the sensor S2.

Then, after a lapse of predetermined time since the sensor S2 detects the front end of the first-folded sheet, the folding processing control section 95*a* controls the motor M1 to shift the guide member 54 from the waiting position to the operating position. The predetermined time at this point is the time elapsed before the sheet front end strikes the stopper member 86, preferably, immediately before the sheet front end strikes the stopper member 86, after being detected by the sensor S2.

At this point, the folding processing control section 95*a* controls the motor M2 corresponding to the sheet size and folding processing form of the sheet, and shifts the stopper member 86 inside the linear passage portion 35*a* of the third path 35. Then, corresponding to the sheet size and folding processing form of the sheet, the folding processing control section 95*a* is beforehand set for the time elapsed before the sheet front end strikes the stopper member 86 after being detected by the sensor S2, and after a lapse of the predetermined time corresponding to the sheet transported in the third path 35, shifts the guide member 54 from the waiting position to the operating position.

The stopper member 86 regulates the sheet, and the sheet thereby forms a loop inside the space formed by outer peripheries of the second folding roller 49 and third folding roller 50.

When the guide member 54 thus moves from the waiting position to the operating position, the fold position of second folding is guided to the nip position Np2 of the second folding roller pair 101 by the guide member 54, and second folding is formed in the sheet as shown in FIG. 14.

The guide member 54 has the projection portion, has substantially the shape of a triangle such that both sides extending from the projection portion conform to outer peripheries of respective opposite second folding roller 49 and third folding roller 50, and therefore, in moving to the operating position, narrows the space formed by the outer peripheries of the second folding roller 49 and third folding roller 50 in which the sheet forms a loop as described previously. By this means, the sheet always forms a certain loop, the guide member 54 guides the accurate fold position, and second folding of high accuracy is formed.

The position of the sheet inside the third path 35 is regulated by the stopper member 86, while being guided to the nip position Np by the guide member 54, the sheet is thereby not slack and is nipped by the second folding roller pair 101, and therefore, fluctuations do not occur in the fold position. Moreover, since the space to form a loop nipped by the second folding roller pair 101 is narrowed, the sheet always forms a certain loop, and does not cause a variation in the fold position which is caused by the fact that the loop shape is not stabilized for each sheet. Accordingly, as long as sheets have the same sheet size and the same folding form, in each of the sheets which is first folded by the first folding roller pair and transported, the fold is always formed in a certain fold position by the second folding roller pair 101.

In FIG. 15, in the folded sheet fed to the second folding position (second nip position) Np2, the fold is reliably folded by the folding enhancement roller 64 in press-contact with the second folding roller 49, and the sheet is carried to the fourth path 36. Then, the folding processing control section 95*a* feeds the folded sheet to the sheet discharge path 37 or feeds the sheet back to the first path 32 corresponding to the beforehand set sorting form. In the apparatus as shown in the figure, in inward three-folding and ⅓ Z-folding of the letter folding form without the need of binding in the post-processing apparatus C, the section 95*a* controls a path switching flapper 66 to guide the sheet from the sheet discharge path 37 to the storage stacker 65.

Further, in the two-folding mode and three-folding mode of ¼ Z-folding or the like for filing or with the need of the post-processing such as bookbinding processing, the sheet is carried to the first path 32 from the fourth path 36, and fed to the post-processing apparatus C from the carrying-out exit 31.

In the apparatus of this Embodiment, the fold of sheet is guided to the first folding roller pair 100 to form first folding. As a substitute therefor, in the case of providing a stopper member in the second path 34 to perform first folding, since it is necessary to shift the stopper member inside the second path 34 that has the longest path length corresponding to the sheet size and folding processing form, the structure is complicated, and the apparatus is increased in size. However, by using the folding deflecting member 53, it is possible to resolve the problem and to make the apparatus compact with the simplified structure. Further, since the folding deflecting member 53 comes into contact with the outer periphery of the second folding roller 49, and guides the fold of the sheet to the nip position Np1 of the first folding roller pair 100, the fold of the sheet is reliably nipped by the first folding roller pair 100, fluctuations do not occur in the fold position, and it is possible to fold the sheet with reliability.

There is the conventional example of adopting the configuration in which the action of the guide member 54 is to come into contact with the periphery of the folding roller 50 on the downstream side of the second folding roller pair 101 in the operating position and guide the fold of the sheet to the nip position Np2 in the same manner as in the folding deflecting member 53. However, when such a driven roller scheme is used in the case of second folding, the folded overlapping portion of the sheet formed in first folding is nipped and transported by the driven roller and the folding roller 50, and a difference occurs in the transport amount between the sheet portion brought into contact with the periphery of the driven roller and the sheet portion brought into contact with the folding roller 50.

Then, when the fold formed in first folding is nipped by the second folding roller pair 101, there is the case where the fold is formed in a position different from the fold formed in first folding, and double folds the so-called bending in the shape of a "U" occur. However, the guide member 54 does not contribute to transport of the sheet, and inconvenience is thereby prevented such that double folds are formed due to a difference in the transport amount between folded both sheet portions.

Accordingly, by providing the folding deflecting member 53 to form first folding and further providing the stopper member 86 and the guide member 54 to form second folding, it is possible to provide the sheet folding apparatus with high folding accuracy.

[Folding Operation in the Two-Folding Mode]

In the above-mentioned folding operation, in the mode for folding the sheet in two, as shown in FIG. 17, the section 95*a* receives a mode instruction signal of whether or not to perform folding processing concurrently with a sheet discharge instruction signal from the image formation apparatus A. Next, the folding processing control section 95*a* calculates the fold position in the fold position calculating means 97 (St01). Then, in the two-folding mode (St02), the folding processing control section 95*a* detects the sheet front end using the sensor S1 (St03). After a lapse of sheet feeding time corresponding to the sheet length calculated in the fold position calculating means 97 from the detection signal (St04), the section 95*a* shifts the folding deflecting member 53 from the waiting position to the operating position (St05). This shift is controlled by rotation of a shift motor Ms.

In the process during which the rack 53*c* of the folding deflecting member 53 shifts to the operating position, as described in FIG. 12, the sheet in the first path 32 is distorted toward the first nip position Np1 with reference to the fold position. Then, when the driven roller 53*a* of the folding deflecting member 53 comes into contact with the periphery of the second folding roller 49, the sheet is drawn and inserted in the first nip position Np1 beginning with the fold position.

At this point, in the two-folding mode, after a lapse of predicted time that the fold of the sheet is inserted in the first nip position Np1 with reference to a detection signal from the sensor S1 (St06), the folding processing control section 95*a* shifts the guide member 54 to the operating position (St07). The predicted time is set at time elapsed before the fold position of the sheet is inserted in the first nip position Np1 and arrives at around the first folding roller pair 100 side of the guide member 54*b*. Accordingly, the front end of the folded sheet is guided to around the first folding roller pair 100 side of the guide member 54*b*, is brought along the periphery of the second folding roller 49 in the state as shown in FIG. 16, and therefore, is guided to the second nip position Np2 even when the front end of the folded sheet is looped in the direction of departing from the second nip position Np2.

Then, the folding processing control section 95*a* carries the folded sheet, which is fed from the second nip position Np2 to the fourth path 36, to the first path 32 from the fourth path 36. Next, the folding processing control section 95*a* prepares for processing of a subsequent sheet in a state in which the guide member 54 is positioned in the operating position (St08). In the apparatus as shown in the figure, in relation to the folding deflecting member 53 positioned in the waiting position, the guide member 54 shifting to positions in the opposite manner is positioned in the operating position, but it is also possible to configure so that the guide member 54 shifts to the waiting position by a detection signal of a sheet discharge sensor S3 (FIG. 16) disposed in the fourth path 36.

[Folding Operation in the Three-Folding Mode]

In the mode for folding the sheet in three, as described in FIGS. 12 to 14, the section 95*a* receives a mode instruction signal of whether or not to perform folding processing concurrently with a sheet discharge instruction signal from the image formation apparatus A. Next, the folding processing control section 95*a* calculates the fold position in the fold position calculating means 97 (St01). Then, in the three-folding mode (St09), folding processing control section 95*a* detects the sheet front end using the sensor S1 (St10).

After a lapse of sheet feeding time corresponding to the sheet length calculated in the fold position calculating means 97 from the detection signal (St11), the folding processing control section 95*a* shifts the folding deflecting member 53 from the waiting position to the operating position (St12). This shift is controlled by rotation of the shift motor Ms.

In the process during which the folding deflecting member 53 shifts to the operating position, as described in FIG. 12, the sheet in the first path 32 is distorted toward the first nip position Np1 with reference to the fold position. Then, when the driven roller 53*a* of the folding deflecting member 53 comes into contact with the periphery of the second folding roller 49, the sheet is drawn and inserted in the first nip position Np1 beginning with the fold position. At this point, in the three-folding mode, the folding processing control section 95*a* waits for the sensor S2 to detect the sheet front end (St13).

After a lapse of predicted time that the front end of the sheet arrives at the stopper member 86 with reference to a detection signal such that the sensor S2 detects the sheet front end (St14), the folding processing control section 95*a* shifts the guide member 54 to the operating position (St15). The predicted time is beforehand set at the time elapsed before the front end of the sheet is detected by the sensor S2 and strikes the stopper member 86 corresponding to the sheet size and folding processing form of the sheet as described previously, and by this means, the sheet is guided to the second nip position Np2 by the guide member 54. Then, the sheet discharge sensor S3 (FIG. 16) detects the sheet front end, and the sheet is carried out to the first path 32 from the fourth path 36, or carried out to the storage stacker 65 from the sheet discharge path 37 corresponding to the folding form.

In addition, when the post-processing mode without performing sheet folding processing is set in the mode setting means 92 described previously, the sheet carried in the first path 32 is fed directly to the sheet carrying-out exit 31.

[Configuration of the Sheet Discharge Path]

The folded sheet that is folded in two or three as described above is fed to the fourth path 36 from the second folding roller pair 101. Then, the sheet is further folded by the roller 64 in press-contact with the second roller 49, and guided to the fourth path 36. The fourth path 36 merges with the first path 32 as described previously. The sheet discharge path 37 branches off from the fourth path 36, is provided via the path switching flapper 66, and guides the folded sheet to the storage stacker 65 disposed below the folding processing passage 33. The sheet discharge roller 67 is disposed in the sheet discharge path 37.

Accordingly, the sheet without the need of carrying to the post-processing apparatus C e.g. the sheet folded in the letter form such as inward three-folding and ⅓ Z-folding is stored in the storage stacker 65 without being carried to the carrying-out exit 31.

Then, in the folded sheet fed to the fourth path 36, the sheet to feed to the post-processing apparatus C for post-processing is carried toward the carrying-out exit 31 by the carrying-out roller 62. In addition, in this case, determination whether or not to perform post-processing is configured to be made by setting the post-processing condition concurrently with the image formation conditions in the control panel. Then, it is configured that the sheet is carried out to the storage stacker 65 or carried to the post-processing apparatus C corresponding to the set finish condition.

[Image Formation Apparatus]

The image formation apparatus A is provided with the following configuration as shown in FIG. 1. In this apparatus, the paper feed section 3 feeds a sheet to the image formation section 7, the image formation section 7 prints in the sheet, and then, the sheet is carried out of the main-body sheet discharge outlet 18. The paper feed section 3 stores sheets of a plurality of sizes in paper cassettes 4*a*, 4*b*, and separates designated sheets on a sheet-by-sheet basis to feed to the image formation section 7. In the image formation section 7, for example, an electrostatic drum 8, and a printing head (laser emitting device) 9, developing device 10, transfer charger 11 and fuser 12 arranged around the drum 8 are disposed, the laser emitting device 9 forms an electrostatic latent image on the electrostatic drum 8, the developing device 10 adds toner to the image, the transfer charger 11 transfers the image onto the sheet, and the fuser 12 heats and fuses the image.

The sheet with the image thus formed is sequentially carried out of the main-body sheet discharge outlet 18. A circulating path 13 is a path for two-side printing for reversing the side of the sheet printed on the frontside from the fuser 12 via a main-body switchback path 14, and then, feeding the sheet to the image formation section 7 again to print on the backside of the sheet. Thus two-side printed sheet is carried out of the main-body sheet discharge outlet 18 after the side of the sheet is reversed by the main-body switchback path 14.

An image reading section 20 scans an original document sheet set on a platen 21 with a scan unit 22, and electrically reads the sheet with a photoelectric conversion element not shown. For example, the image data is subjected to digital processing in an image processing section, and then, transferred to a data storing section 16, and an image signal is sent to the laser emitting device 9. Further, a feeder apparatus 25 feeds original document sheets stored in a stacker 26 to the platen 21.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from the control panel 15.

Meanwhile, the image formation apparatus A is configured so that image data read by the scan unit 22 or image data transferred from an external network is stored in the data storing section 16, the data storing section 16 transfers the image data to buffer memory 17, and that the buffer memory 17 transfers a data signal to the printing head 9 sequentially.

Concurrently with the image formation conditions, a post-processing condition is also input and designated from the control panel 15. As the post-processing condition, for example, selected is a "printout mode", "staple binding mode", "sheet-bunch folding mode" or the like. The post-processing condition is set for the folding form in the sheet folding apparatus B as described previously.

[Post-Processing Apparatus]

Figure 18:
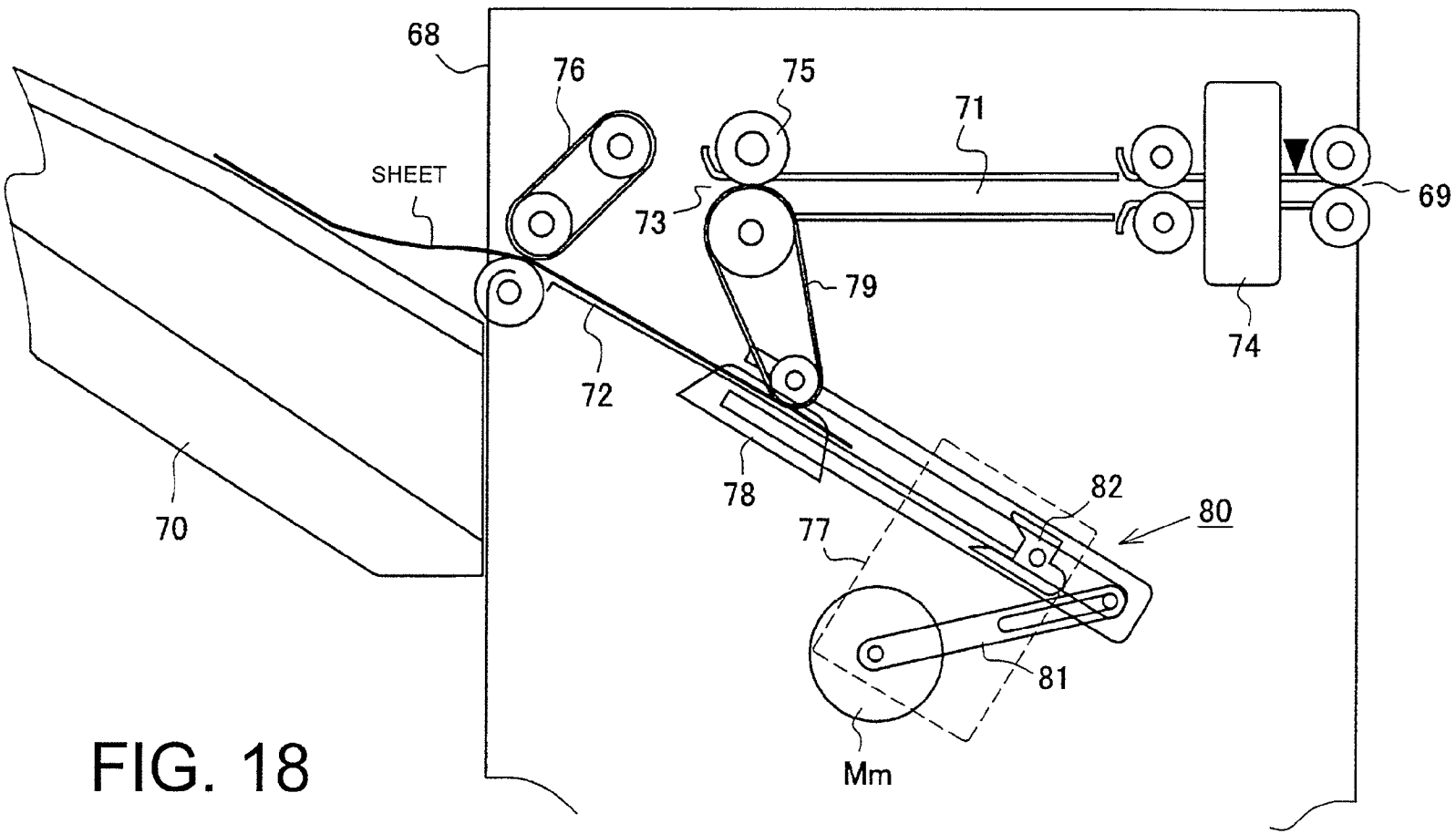
FIG. 18 shows an enlarged explanatory view of principal part of a post-processing apparatus in the system of FIG. 1.

As shown in FIG. 18, the post-processing apparatus C is provided with the following configuration. This apparatus has an apparatus housing 68 provided with the sheet receiving opening 69, sheet discharge stacker 70, and post-processing path 71. The sheet receiving opening 69 is coupled to the carrying-out exit 31 of the sheet folding apparatus B, and is configured to receive a sheet from the first transport path 32 or the fourth transport path 36.

The post-processing path 71 is configured to guide the sheet from the sheet receiving opening 69 to the sheet discharge stacker 70, and a processing tray 72 is provided in the path. A sheet discharge outlet 73 collects sheets from the post-processing path 71 in the processing tray 72 disposed on the downstream side. A punch unit 74 is disposed in the post-processing path 71. A sheet discharge roller 75 is disposed in the sheet discharge outlet 73 to collect a sheet from the sheet receiving opening 69 in the processing tray 72.

On the processing tray 72, sheets from the post-processing path 71 are switch-back transported (in the direction opposite to the transport direction), and collated and collected using a rear end regulating member (not shown) provided on the tray. Therefore, above the tray is provided a forward/backward rotation roller 75 for switching back the sheet from the sheet discharge outlet 73. Further, the processing tray 72 continues to the sheet discharge stacker 70, and the sheet from the sheet discharge outlet 73 is supported (bridge-supported) on the front end side by the sheet discharge stacker 70 and on the rear end side by the processing tray 72.

On the processing tray 72 is disposed a stapler unit 77 for binding a sheet bunch positioned by the rear end regulating member. Aligning means 78 aligns the width of the sheet carried onto the processing tray in the direction orthogonal to the transport direction. A paddle rotating body 79 is coupled to a rotating shaft of the sheet discharge roller 75 to be driven to carry the sheet from the sheet discharge roller 75 toward the rear end regulating member.

Sheet bunch carrying-out means 80 carries a sheet bunch bound by the stapler unit 77 to the sheet discharge stacker 70 on the downstream side. Therefore, the sheet bunch carrying-out means 80 shown in the figure is comprised of a lever member 81 axially supported at the base end portion to be swingable, and a sheet end engagement member 82.

Then, the sheet end engagement member 82 is equipped in the processing tray to reciprocate in the sheet discharge direction along the processing tray 72, and is coupled to the lever member 81. A driving motor Mm causes the lever member 81 to perform swinging motion. In addition, the sheet discharge stacker 70 is provided with an elevator mechanism, not shown, which moves up and down corresponding to a load amount of sheets.

AS described above, in the sheet folding apparatus as shown in the figures according to the invention, the first folding roller pair 100 for first folding a sheet and the second folding roller pair 101 for second folding the sheet are arranged successively along the sheet transport direction in the folding processing passage 33 for transporting the sheet, the stopper member 86 is provided inside the third path 35 of the folding processing passage 33, and when the front end of the sheet, which is first folded in the nip position Np1 of the first folding roller pair and transported, strikes the stopper member 86, the guide member 54 guides the fold to undergo second folding of the first-folded sheet to the nip position Np2 of the second folding roller pair 101 to form second folding on the sheet.

Accordingly, the sheet is pushed into the nip position Np by the guide member 54, is thereby not slack and is nipped by the second folding roller pair 101, and therefore, fluctuations do not occur in the fold position. Moreover, since the space to form a loop nipped by the second folding roller pair 101 is narrowed, there is no variation in the fold position which is caused by the fact that the loop shape is not stabilized for each sheet. Accordingly, as long as sheets have the same sheet size and the same folding form, in each of the sheets which is first folded by the first folding roller pair and transported, the fold is always formed in a certain fold position by the second folding roller pair 101.

The present invention relates to an apparatus for performing the folding processing for folding, in a predetermined fold position, a sheet with an image formed in an image formation apparatus such as a printing press, printer apparatus and copier, and has industrial applicability.

In addition, this application claims priority from Japanese Patent Application No. 2011-099384 and Japanese Patent Application No. 2011-099385 incorporated herein by reference.

What is claimed is:

1. A sheet folding apparatus for forming a fold in a sheet transported into a transport path, comprising:

a first folding roller pair for forming first folding in a sheet, comprising a first folding roller positioned on an upstream side in a sheet transport direction in the apparatus, and a second folding roller, positioned on a downstream side in the sheet transport direction in the apparatus, in contact with an outer periphery of the first folding roller to rotate in an opposite direction;

a folding deflecting member that comes into press-contact with an outer periphery of the second folding roller to guide a fold of the sheet to a nip position of the first folding roller pair;

a second folding roller pair for forming second folding in the sheet with the first folding formed, comprising the second folding roller, and a third folding roller in contact with the outer periphery of the second folding roller to rotate in an opposite direction;

a stopper member provided to strike, in a predetermined position, a front end of the sheet with the first folding formed; and a guide member movable between an operating position for guiding the sheet with the first folding formed to a nip position of the second folding roller pair and to waiting position retracted from the operating position, the guide member moving towards the nip position of the second folding roller pair to guide the sheet with the first folding formed to form the second folding after the front end of the sheet with the first folding arrives at the stopper member, wherein the guide member is in the waiting position when the sheet that is first folded in the first folding roller pair is transported to the stopper member, and moves to the operating position when the front end of the sheet arrives at the stopper member.

2. A sheet folding apparatus for forming a fold in a sheet transported into a transport path, comprising:

a first folding roller pair for forming first folding in a sheet, comprising a first folding roller positioned on an upstream side in a sheet transport direction in the apparatus, and a second folding roller, positioned on a downstream side in the sheet transport direction in the apparatus, in contact with an outer periphery of the first folding roller to rotate in an opposite direction;

a folding deflecting member that comes into press-contact with an outer periphery of the second folding roller to guide a fold of the sheet to a nip position of the first folding roller pair;

a second folding roller pair for forming second folding in the sheet with the first folding formed, comprising the second folding roller, and a third folding roller in contact with the outer periphery of the second folding roller to rotate in an opposite direction;

a stopper member provided to strike, in a predetermined position, a front end of the sheet with the first folding formed;

a guide member movable between an operating position for guiding the sheet with the first folding formed to a nip position of the second folding roller pair and a waiting position retracted from the operating position, the guide member moving towards the nip position of the second folding roller pair to guide the sheet with the first folding formed to form the second folding after the front end of the sheet with the first folding arrives at the stopper member;

a first transport path having a carry-in entrance and a carrying-out exist for the sheet;

a second transport path branching off in a substantially orthogonal direction to the sheet transport direction in the first transport path, in a branch point provided between the carry-in entrance and the carrying-out exit; and a third transport path branching off in a substantially opposite direction to the sheet transport direction in the second transport path from the branch point to form a folding processing passage together with the second transport path.

3. The sheet folding apparatus according to claim 2, wherein each of the second transport path and the third transport path has a curved passage portion.

4. The sheet folding apparatus according to claim 2, wherein the first transport path comprises a substantially linear path, the second transport path has a passage portion curved in a shape of an arc along a top of the apparatus, and the third transport path has a substantially linear passage portion along a side plate on the carry-in entrance side.

5. The sheet folding apparatus according to claim 2, wherein the first folding roller is disposed so that part of the outer periphery faces the first transport path, and the second folding roller is disposed in a place on a downstream side of the first folding roller in a sheet transport direction of the first transport path while being away from the first transport path.

6. The sheet folding apparatus according to claim 2, wherein the stopper member, the second folding roller pair and the guide member are disposed in the third transport path.

7. The sheet folding apparatus according to claim 6, wherein the third transport path has a mylar to reduce friction with the sheet in a place for coming into contact with the front end of the sheet introduced from the first folding roller pair.

8. The sheet folding apparatus according to claim 2, wherein the third transport path has a mylar to reduce friction with the sheet in a place for coming into contact with the sheet guided to the nip position of the second folding roller pair by the guide member.

9. The sheet folding apparatus according to claim 6, wherein the predetermined position in which the stopper member strikes the front end of the sheet shifts in a linear passage portion formed in the third transport path.

10. The sheet folding apparatus according to claim 2, wherein the third transport path is present between the guide member and the second folding roller pair.

11. A sheet folding apparatus for forming a fold in a sheet transported into a transport path, comprising:

a first folding roller pair for forming first folding in a sheet, comprising a first folding roller positioned on an upstream side in a sheet transport direction in the apparatus, and a second folding roller, positioned, on a downstream side in the sheet transport direction in the apparatus, in contact with an outer periphery of the first folding roller to rotate in an opposite direction;

a folding deflecting member that comes into press-contact with an outer periphery of the second folding roller to guide a fold of the sheet to a nip position of the first folding roller pair;

a second folding roller pair for forming second folding in the sheet with the first folding formed, comprising the second folding roller, and a third folding roller in contact with the outer periphery of the second folding roller to rotate in an opposite direction;

a stopper member provided to strike, in a predetermined position, a front end of the sheet with the first folding formed; and a guide member movable between an operating position for guiding the sheet with the first folding formed to a nip position of the second folding roller pair and a waiting position retracted from the operating position, the guide member moving towards the nip position of the second folding roller pair to guide the sheet with the first folding formed to form the second folding after the front end of the sheet with the first folding arrives at the stopper member, wherein the first folding roller comprises a rotating plate and a rotating shaft axially supporting the rotating plate, and the guide member is attached to the rotating plate.

12. The sheet folding apparatus according to claim 10, further comprising a fourth transport path extending from between the second folding roller pair along the second folding roller to the carrying-out exist.

* * * * *